US007824051B2

(12) United States Patent
Walter et al.

(10) Patent No.: US 7,824,051 B2
(45) Date of Patent: Nov. 2, 2010

(54) COLOR CHANGING LIGHT OBJECT AND USER INTERFACE FOR SAME

(75) Inventors: Scott D. Walter, Twin Lakes, WI (US); Kevin Harrity, Oak Creek, WI (US); Dennis W. Gruber, Arlington Heights, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 744 days.

(21) Appl. No.: 11/327,167

(22) Filed: Jan. 6, 2006

(65) Prior Publication Data

US 2006/0158138 A1 Jul. 20, 2006

Related U.S. Application Data

(60) Provisional application No. 60/641,440, filed on Jan. 6, 2005.

(51) Int. Cl.
*F21V 33/00* (2006.01)

(52) U.S. Cl. ..... 362/101; 362/96

(58) Field of Classification Search ..... 362/96, 362/101, 154, 155, 158, 190, 251, 267, 276, 362/318, 326, 394, 562, 604, 605, 612, 613, 362/615, 631, 800, 802, 806–809; 315/51, 315/129, 130

See application file for complete search history.

(56) References Cited

U.S. PATENT DOCUMENTS 4,436,308 A * 3/1984 Rose et al. ..... 463/31
4,866,580 A 9/1989 Blackerby
5,575,553 A * 11/1996 Tipton ..... 362/101
5,879,068 A * 3/1999 Menashrov et al. ..... 362/101
5,924,784 A * 7/1999 Chliwnyj et al. ..... 362/234

(Continued)

FOREIGN PATENT DOCUMENTS

CN 1288126 A 3/2001

(Continued)

OTHER PUBLICATIONS

International Preliminary Report on Patentability and Written Opinion PCT/US2006/000148; report dated Jul. 10, 2007.

(Continued)

*Primary Examiner*—Hargobind S Sawhney

(57) ABSTRACT

Illuminated, decorative light objects are disclosed that provide at least one aesthetic lighting display or light show, and to a user interface for the same. A disclosed decorative light object includes a translucent housing. The housing has a bottom opening leading into a cavity. The object also includes a base assembly that covers the bottom opening of the housing. The base assembly includes a user interface. The user interface includes light show circuitry, memory for storing a plurality of light shows, switches or buttons for recalling the light shows from the memory and at least one light group comprising red, green and blue lights. The switches of the user interface are supported in the bottom opening. The light show circuitry, memory and lights are supported within the cavity. Preferably, a translucent light pipe with a roughened lambertian outer surface covers and hides the circuitry and the lights. As the light shines through the light pipe it is diffused thereby creating a warm glowing appearance.

16 Claims, 22 Drawing Sheets

U.S. PATENT DOCUMENTS

| | | | | |
|---|---|---|---|---|
| 5,945,993 | A * | 8/1999 | Fleischmann | 715/771 |
| 6,031,958 | A | 2/2000 | McGaffigan | |
| 6,163,248 | A * | 12/2000 | Paek et al. | 340/321 |
| 6,241,362 | B1 * | 6/2001 | Morrison | 362/231 |
| 6,361,186 | B1 | 3/2002 | Slayden | |
| 6,361,192 | B1 | 3/2002 | Fussell et al. | |
| 6,416,198 | B1 * | 7/2002 | Vanderschuit | 362/101 |
| 6,431,719 | B1 | 8/2002 | Lau et al. | |
| 6,527,411 | B1 | 3/2003 | Sayers | |
| 6,536,914 | B2 | 3/2003 | Hoelen et al. | |
| 6,608,453 | B2 * | 8/2003 | Morgan et al. | 315/312 |
| 6,616,308 | B2 | 9/2003 | Jensen et al. | |
| 6,717,376 | B2 * | 4/2004 | Lys et al. | 315/292 |
| 6,752,517 | B2 | 6/2004 | Hildebrand et al. | |
| 6,793,362 | B2 * | 9/2004 | Tai | 362/101 |
| 6,801,003 | B2 * | 10/2004 | Schanberger et al. | 315/291 |
| 6,863,415 | B2 * | 3/2005 | Lu | 362/101 |
| 6,965,205 | B2 * | 11/2005 | Piepgras et al. | 315/318 |
| 7,161,556 | B2 * | 1/2007 | Morgan et al. | 345/1.1 |
| 7,175,294 | B1 * | 2/2007 | Estrada et al. | 362/101 |
| 2002/0140379 | A1 * | 10/2002 | Chevalier et al. | 315/291 |
| 2002/0176260 | A1 | 11/2002 | Liao | |
| 2003/0028260 | A1 * | 2/2003 | Blackwell | 700/18 |
| 2004/0036424 | A1 | 2/2004 | Hsieh | |
| 2004/0095746 | A1 | 5/2004 | Murphy | |
| 2004/0179355 | A1 | 9/2004 | Gabor | |
| 2004/0257817 | A1 | 12/2004 | Philipp | |
| 2005/0013129 | A1 * | 1/2005 | Zhang | 362/96 |
| 2005/0078472 | A1 * | 4/2005 | Wiest | 362/101 |
| 2005/0207141 | A1 * | 9/2005 | Boesch et al. | 362/101 |
| 2006/0238136 | A1 * | 10/2006 | Johnson, III et al. | 315/185 R |

FOREIGN PATENT DOCUMENTS

| | | |
|---|---|---|
| CN | 2432436 Y | 5/2001 |
| DE | 296 12 347 | 9/1996 |
| FR | A-2 591 152 | 6/1987 |
| WO | WO 02/45467 A3 | 6/2002 |

OTHER PUBLICATIONS

Chinese Office Action 2006800041630; issued Sep. 19, 2008.

* cited by examiner

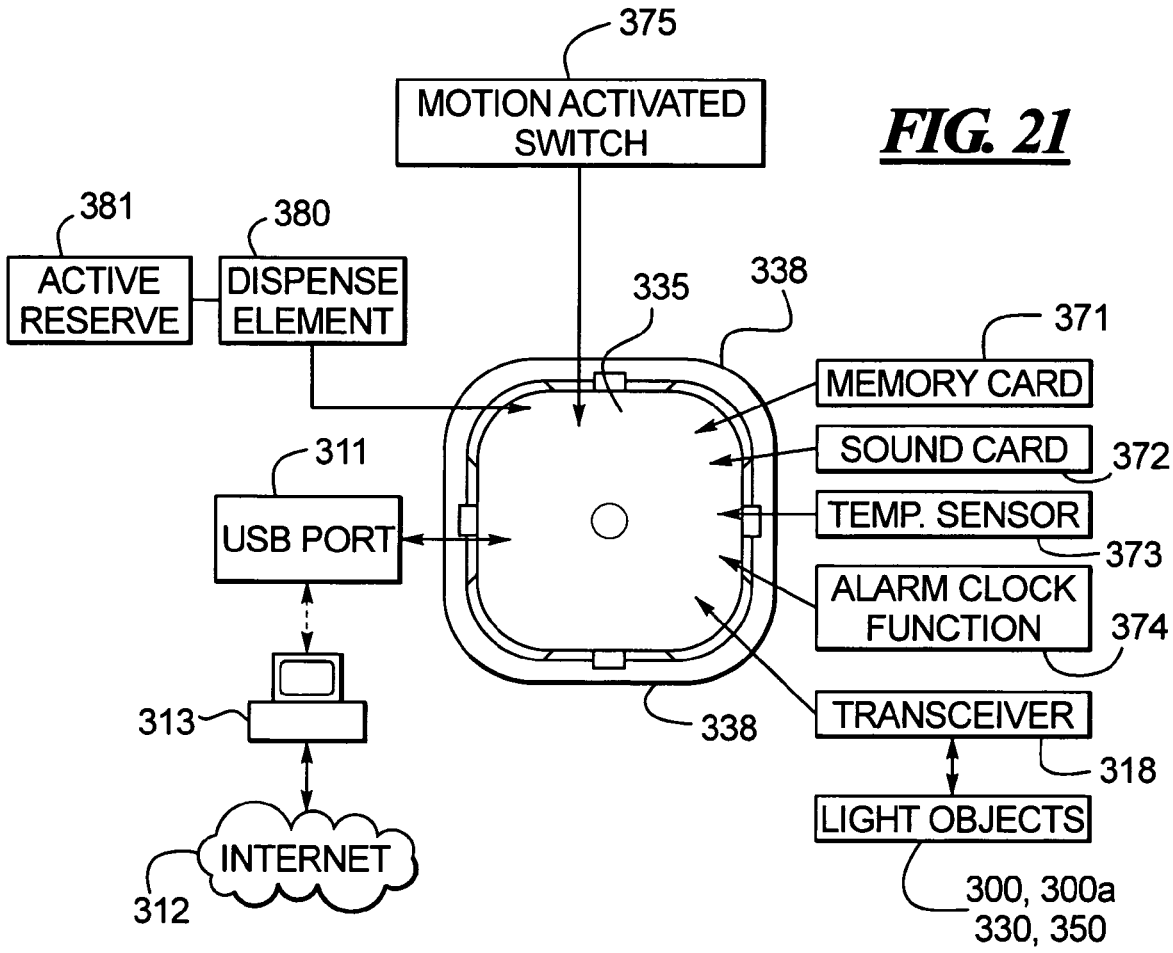
FIG. 21
FIG. 22
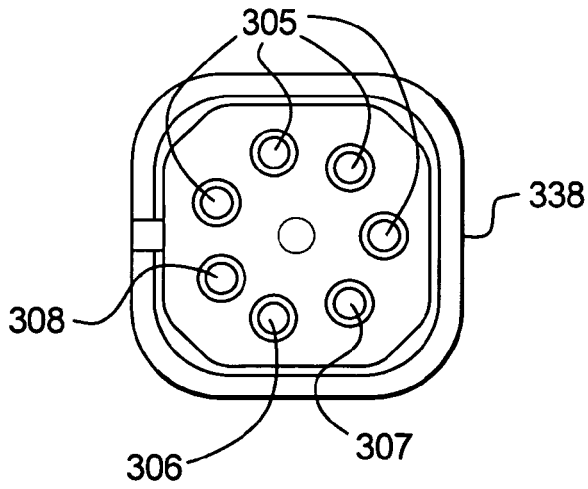

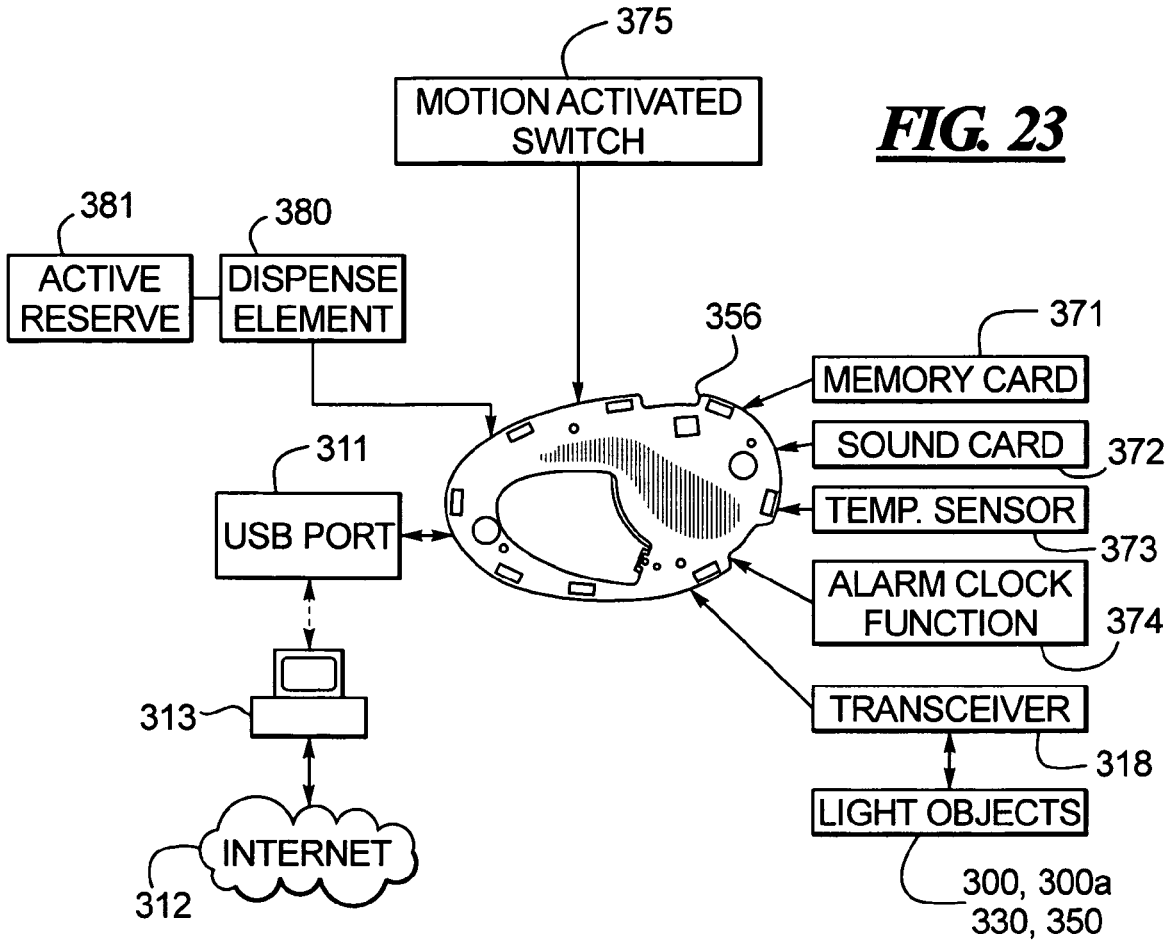
FIG. 23
FIG. 24
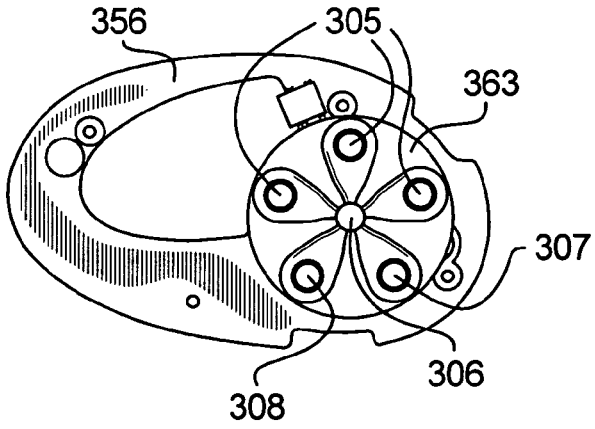

COLOR CHANGING LIGHT OBJECT AND USER INTERFACE FOR SAME

BACKGROUND

1. Technical Field

Decorative light objects used as home furnishings and user interfaces for the same are disclosed. The disclosed decorative light objects provide one or more aesthetic lighting displays or light shows. Disclosed user interfaces that fit in the base of a decorative object provide one or more aesthetic lighting displays or light shows through the decorative light object.

2. Description of the Related Art

Various decorative illuminated objects are known in the art, which display one or more lighting effects. For example, U.S. Pat. No. 6,801,003 ("Schanberget") discloses lighting systems for swimming pools, wall-mounted lighting systems, and window-mounted light-systems that include a processor that is configured to control a color-changing lighting effect generated by the lighting apparatus. Schanberget discloses that the lighting system may also include memory storing one or more lighting programs and/or data. The lighting systems may also include a user interface used to change and/or select the lighting effects generated by the lighting system. Schanberget also discloses that the lighting system may be provided with a plurality of LEDs controlled such that the light outputs from two or more of the LEDs combine to produce a mixed colored light, and that the lighting system may be used in a variety of larger scale applications such as indoor and outdoor displays, decorative illumination, and special effects illumination.

U.S. Pat. No. 6,536,914 ("Hoelen") discloses an illumination system for illuminating a display device, comprising a light-emitting panel having at least one edge surface for coupling light into the light-emitting panel. The Hoelen illumination system further comprises a light source comprising a plurality of clusters of light-emitting diodes, each cluster includes one blue, one green, and one red LED. Hoelen uses a mixing chamber with a dimensional relationship to the arrangement of the LED clusters to achieve a uniform, non-dynamic light distribution.

U.S. Patent Application Publication No. 2004/0179355 ("Gabor") discloses a battery powered electronic candle with a bulb, LED or other lighting source. A candle-emulating lighting source is contained within a transparent cylinder of the device with the contact plates electrically connected to terminals of a flicker circuit emulating board. The board is adaptable to LEDs of different colors (e.g., red, green, blue or yellow).

Other known lighting devices are described in U.S. Pat. No. 6,616,308 which discloses a simulated candle, U.S. Pat. No. 6,361,186 which discloses a simulated neon light using LEDs, while controls for lighting display devices are described in U.S. Pat. No. 6,431,719, U.S. Pat. No. 4,866,580, and U.S. Patent Publication No. 2004/0036424.

However, there are deficiencies associated with each of the foregoing lighting devices. For example, the known interfaces for the devices described above are not particularly versatile or user friendly. None of the above devices include a user interface that can be interchanged with a different user interface or a replacement interface that includes one or more new and different light shows stored in the memory thereof. None of the disclosed devices include a user interface or a memory card that may be easily removed and replaced with a new interface or memory card. None of the above devices include a user friendly interface that makes it easy to select a particular light show, that makes it easy to pause a show in progress or that makes it easy to adjust the intensity of a show in progress.

Further, none of the above devices include a remote control. Similarly, none of the disclosed devices include a wireless communication capability that would enable two devices disposed in a room or on a mantle to be synchronized with each other. None of the above devices are capable of downloading new information or light shows from the internet or from the memory of a PC. Sound is not an option with the currently available devices. The known devices are not responsive to environmental conditions such as ambient sound, temperature or light. Accordingly, there remains a need in the art for improved decorative lighting displays.

SUMMARY OF THE DISCLOSURE

Generally, illuminated, decorative light objects are disclosed that provide at least one aesthetic lighting display or light show, and to a user interface for the same.

As used herein, elements described as being "translucent" are those materials permitting the passage of light, including but not limited to clear materials, colored transparent materials, materials that both transmit and diffuse light so that objects beyond cannot be seen clearly, and materials having a combination of these characteristics.

As used herein, the term "mean light direction" refers to the approximate average direction of the sum of all light rays traveling through the housing.

As used herein, the term "lambertian" refers to a surface capable of perfect light diffusion, or light diffusion that is equal in all directions in accordance with Lambert's Law. The term "near-lambertian" refers to a surface capable of excellent light diffusion, or light diffusion that is nearly equal in all directions.

In one aspect, a disclosed light object comprises a translucent housing, a base, and a first light source. The housing has an internal cavity defining an opening therein. The base is attachable to the housing and substantially covers the opening in the housing. The first light source is disposed on the base for displaying at least one multi-colored light show.

In one aspect, a plurality of sources are provided, disposed on the base so as to be received in the cavity and spaced apart from the opening in the housing. The other light source or sources are capable of transmitting light through a wall of the housing to be emitted from the light object.

In another aspect, the opening in the housing comprises a substantially planar surface around the periphery of the cavity and serves as a light interface. Also preferably, the first light source is positioned adjacent to the opening in the housing and transmits light via the light interface into a wall of the housing to illuminate the housing.

Certain disclosed light objects include what will hereinafter be referred to as a "light pipe" which covers the base, electronics on the base and the light sources and is disposed between the base and the cavity of the housing. In certain arrangements, the light pipe is shaped to closely match the shape of the housing cavity although it is preferably spaced apart from the interior walls of the housing that define the cavity. Preferred light pipes include either roughened interior or exterior surfaces to aid in light diffusion. This roughening of the interior or exterior surface enhances light diffusion. A lambertian or near-lambertian surface on the light pipe can be easily achieved by sandblasting or roughening using a conventional scouring pad made from a nylon web and coarse mineral abrasives. Other techniques for roughening the interior or exterior surface of a light pipe or the interior or exterior surface of the light object housing to enhance light diffusion will be apparent to those skilled in the art.

In another aspect, the surface defining the cavity comprises a light-diffusing surface that diffuses light from the first and/or second light sources before being emitted from the light object. Preferably, the light-diffusing surface comprises at least one of a sandblasted finish, a frosted finish, an etched finish, and a light diffusing coating to provide a lambertian or near-lambertian surface.

In a different aspect, the housing can comprise a reflecting surface that reflects a substantial portion of light in the wall of the housing that is incident to the reflecting surface. The reflecting surface preferably comprises a surface oriented such that an angle of incidence of a mean light direction relative to the surface is at least equal to the critical angle of the housing material.

In yet another aspect, the first light source comprises a light emitting diode array including a plurality of different colored light emitting diodes (LEDS) more preferably, a red/green/blue (RGB) array of LEDS, while the other light source or sources preferably comprise RGB arrays of LEDS. Preferably, the LED arrays are mounted on a board disposed on or supported by the base.

The light object preferably includes a memory for storing data corresponding to at least one preprogrammed light show. Preferably, the light object also includes an auto-shutoff, which turns the light object off after a predetermined period with no user input.

In another aspect, the light object comprises a user interface, by which a user can select a desired display setting from among a device OFF setting, at least one light show setting in which the first light source is on, and at least one illumination setting in which the second or other light sources are on. The interface preferably also includes a freeze button, by which, when one of the at least one light show settings is selected on the user interface, the user can freeze the light show at a desired point (i.e., color) in the light show.

In one disclosed arrangement, improved user interfaces for light objects are disclosed. One user interface comprises a control switch, a mode switch, and, preferably, a flicker switch. With the control switch, a user can select between an OFF position, in which no light is emitted from the light object, a light show position, in which the light object is illuminated with multi-colored light in a predetermined pattern, and an illumination position, in which a single color (or possibly two similar colors) of light is continuously emitted from the light object. With the mode switch, the user can select a desired light show to display from among a plurality of preprogrammed light shows when the control switch is in the light show position. With the flicker switch, the user can switch between a steady illumination mode and a flicker illumination mode, when the control switch is in the illumination position. Of course, the user interfaces described herein are also applicable to light objects without a second light source, in which case, the flicker switch and the illumination position of the control switch can be omitted. Buttons and switches, for these purposes, are considered interchangeable. Instead of a single mode switch or button, numbered mode buttons may be employed for selected numbered light shows.

In another arrangement, the user interface comprises a control switch and a freeze button. With the control switch of this arrangement, a user can select between an OFF position, in which no light is emitted from the light object, a first light show position, in which the light object is illuminated in a first preprogrammed light show, a second light show position, in which the light object is illuminated in a second preprogrammed light show, a third light show position, in which the light object is illuminated in a third preprogrammed light show, a steady illumination mode, in which the second light source emits a steady (i.e., substantially constant intensity) illumination, and a flicker illumination mode, in which the second light source emits a flickering (i.e., changing intensity) illumination. With the freeze button, the user can freeze a light show at a desired point in the light show, when the control switch is in one of the first, second, or third light show positions.

In another aspect, the user interface comprises an ON/OFF button, a FLICKER button, a PAUSE button, and a plurality of numbered buttons, each number button being assigned to a particular stored light show. In such an embodiment, the interface includes memory or a memory card for storing a plurality of light shows.

In yet another aspect, the user interface includes a sound card for generating sounds associated with the one or more light shows. In still another aspect, the circuitry of the user interface includes a temperature sensor and control circuitry that alters any given light show based upon the ambient temperature sensed by the temperature sensor. In yet another aspect, the interface and/or base includes a USB connection that enables the light object to be linked to a personal computer so that new or different light shows may be downloaded from the Internet with or without user input. Thus, the light shows associated with numbered buttons on the interface may be changed and swapped with other light shows downloaded from the Internet. Further, the user may also modify a selected light show by way of software installed on his or her personal computer that is used to download to shows from the Internet.

In another aspect, the user interface includes a motion-activated switch, such as a mercury switch or, more preferably, an accelerometer, which turns on a back light installed in the user interface on when the light object is tilted to activate the user interface.

In another aspect, the light object includes a transceiver for communicating with a removable remote control-type interface as described above. In another related aspect, the light object includes a transceiver for communicating with another similarly equipped light object. Thus, two light objects can communicate with each other and the light shows presented on the light objects can be synched with one another. In a related aspect, more than two light objects may be incorporated in a "system" used in a home that communicate with each other and present light shows in sync with one another. In another related aspect, interfaces for light objects can be capable of downloading light shows from a personal computer in a wireless fashion thereby eliminating the need for a USB port for Internet downloading.

In another aspect, light show interfaces may be equipped with alarm clock functions for turning on and turning off the objects at specified times. In another aspect, the housing and light pipes may be fabricated from either glass or resin materials.

Another aspect involves the use of a sound card which enables the light object to produce sound. The different aspect involves the use of a sound card that enables the light object to respond to sound within the room thereby altering the light show in response to ambient sound similar to the embodiment described above whereby the light show is altered in response to the ambient temperature.

In yet another aspect, a base for a light object comprises a body, a first light source, and, preferably, one or more additional light sources. The body has a supporting portion and a protruding portion. The light sources are disposed on the base adjacent to the supporting portion, and are capable of displaying at least one multi-colored light show stored in a memory. If provided, an additional light source is disposed on the protruding portion of the base, and has a first illumination mode in which light output is steady, and a second illumination mode in which the light output flickers.

As described above, a light object generally comprises a translucent housing having an internal cavity, a base attachable to the housing and having a protruding portion that extends into the cavity in the housing, and the light sources located in the housing and/or base. The housing can be fashioned in any desired shape and size, so long as the housing is sufficiently large that the internal cavity can accommodate the light sources. Preferably, the housing has an aesthetically pleasing design, such as a vase, sculpture, or the like.

The housing can be made of any suitable translucent material. Preferably, however, the housing is made of substantially clear, un-occluded glass or polyurethane. In addition, different portions and/or surfaces of the housing may have different optical characteristics. For example, either the internal surface of the cavity or the external surface of the light pipe comprises a light-diffusing surface that diffuses light from the second light source before it is emitted from the light object. The light-diffusing surface comprises a sandblasted finish applied using a conventional sandblasting technique. However, the surface of the cavity or the light pipe may be subjected to a variety of other conventional types of processes and/or coatings to achieve the desired light-diffusing finish. For example, the light-diffusing surface may be imparted by one or more of etching, frosting, knurling, otherwise roughening, applying a light-diffusing coating (such as a conventional silica coating used in light bulbs), or the like.

The base can be made of any suitable material, including plastic, metal, glass, polymers, and the like, depending on various design considerations, such as cost, weight, conductivity, and aesthetic appearance.

As the light sources, any type of lighting element or elements may be used, such as, for example, light emitting diodes (LEDs), incandescent bulbs, fluorescent bulbs, or the like. Preferably, however, the first light source comprises a RGB array of LEDs and the other sources comprise RGB arrays of LEDs.

One preferred light object embodiment includes a vertical outer housing or shell with an interior cavity and a bottom opening. A base is mateably received and fits within the opening. The base supports an interface that comprises a push button pad and a circuit board. One or more frame members can be used to secure the base within the opening and to further support a light pipe that fits over the base. The light pipe can serve two functions. First, the light pipe can serve as a cover for the electronic components mounted to the base to keep them hidden from view and, second, the light pipe can be used to diffuse light. Again, either the outer or inner surface of the light pipe can be roughened to form a lambertian or near-lambertian surface for diffusing light. In this way, the light pipe can be roughened and the interior or exterior surfaces of the housing need not be roughened. As an alternative to roughening either the interior or exterior surfaces of the light pipe, the interior surface or the exterior surface of the housing can be roughened and the light pipe can be used simply to hide the electronic components. This disclosure is not limited to light objects with only one roughened surface; it may be advantageous to roughen more than one surface.

The interface may also include a USB connection or a transceiver for wirelessly communicating with a personal computer linked to the Internet so that additional light shows may be downloaded from a website and/or modified using a personal computer. The interface may also be removable and used as a remote control and light objects may include two interfaces disposed in the base including a first permanently mounted interface that is not removable and a removable remote-control-type interface. The circuit board of the interface may be equipped with a memory card, a sound card, a temperature sensor, an alarm clock function and one or more transceivers. One transceiver could be used to communicate with a remote control interface and another transceiver could be used to communicate with other light objects. Of course, one transceiver could be designed to cover both functions.

In another aspect, a light object in the form a bowl is disclosed. The bowl includes an opening disposed in the base which is also disposed beneath the container portion or open cavity of the bowl. The bowl has an open top. The base also includes an interface comprising a circuit board with a plurality of RGB LEDs mounted on the board. A push-button mechanism may be incorporated into the board or provided separately. The interface may include one or more or all of the additional functions recited above. A light pipe is used to cover the interface and therefore keep the electronic components hidden. The push-buttons or switches of the interface are accessed by inverting the bowl.

A better understanding of these and other features and advantages may be had by reference to the drawings and to the accompanying description, in which preferred embodiments are illustrated and described.

BRIEF DESCRIPTION OF THE DRAWINGS

FIG. 21 is a top view of the interface of the light object shown in FIGS. 15-17;

FIG. 22 is a bottom plane view of the interface of the light object shown in FIGS. 15-17;

FIG. 23 is a top plane view of the interface of the light object shown in FIGS. 18-20; and FIG. 24 is a bottom plane view of the interface of the light object shown in FIGS. 18-20.

Throughout the figures, like or corresponding reference numerals have been used for like or corresponding parts.

DETAILED DESCRIPTION OF THE PRESENTLY PREFERRED EMBODIMENTS

Figure 1:
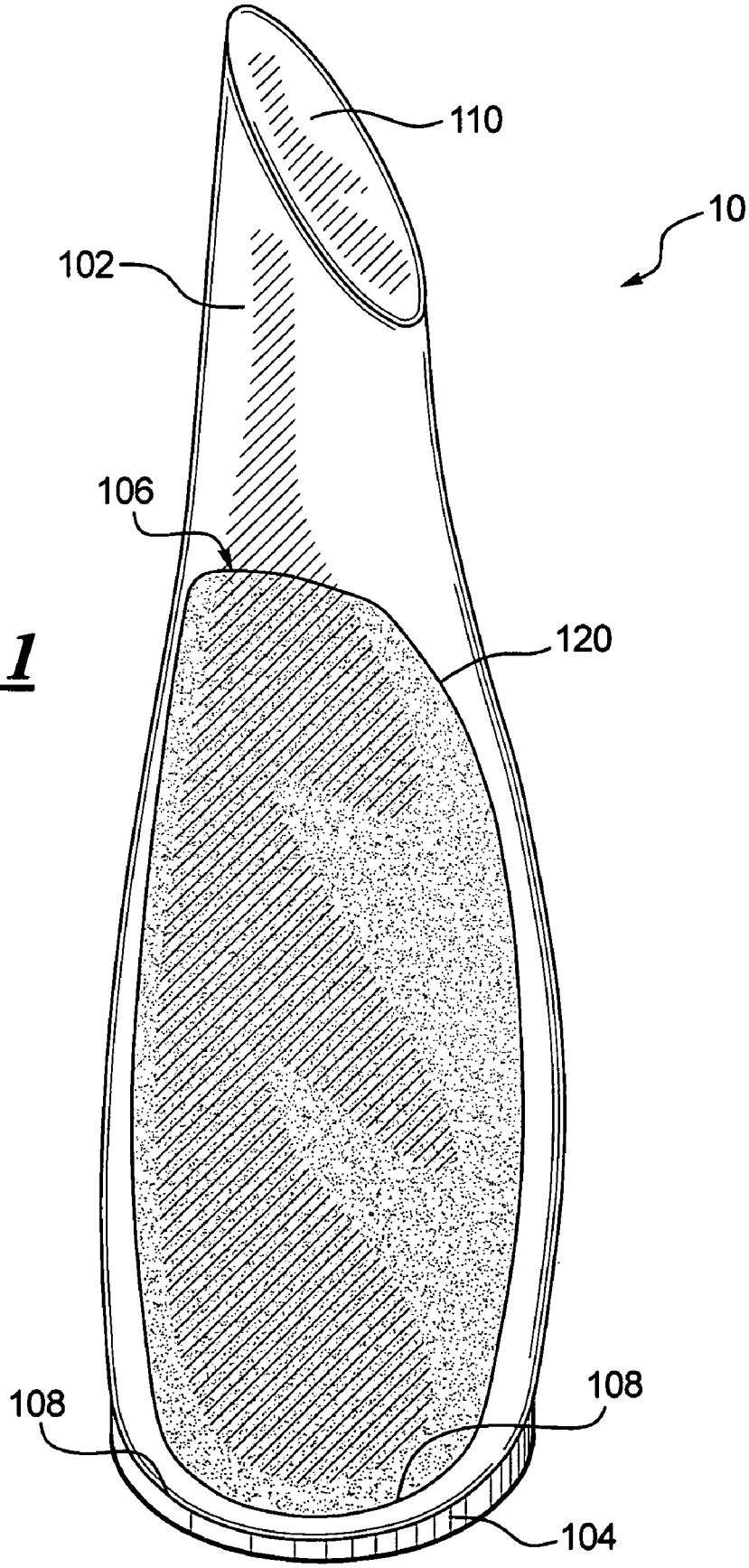
FIG. 1 is a perspective view of a light object according to one disclosed embodiment.

A curved light object 10 according to one preferred embodiment is shown in FIGS. 1-4. The light object 10 generally comprises a translucent housing 102 with a base 104 attachable thereto by one or more removable fasteners (not shown). The housing 102 of this embodiment is generally in the shape of an amphora (but without any handles) and has an internal cavity 106 formed therein, which defines an opening 108 in the housing 102. The surface 120 of the cavity 106 is sandblasted to provide a roughened, light-diffusing surface. The base 104 substantially covers the opening 108 in the housing 102 (when mounted to the housing), and a protruding portion 112 of the base 104 extends into the cavity 106. The fasteners used to attach the housing 102 to the base 104 preferably fasten to legs (not visible in the drawings) protruding from the bottom of the housing 102 around the opening 108. Of course, numerous other methods of attaching the housing 102 and base 104 could be used, as will be apparent to one of ordinary skill in the art. As mentioned above, the base 104 can be made of a variety of materials. Preferably, however, in this embodiment, the base 104 is made of aluminum, and may be polished and/or plated if desired.

Figure 3:
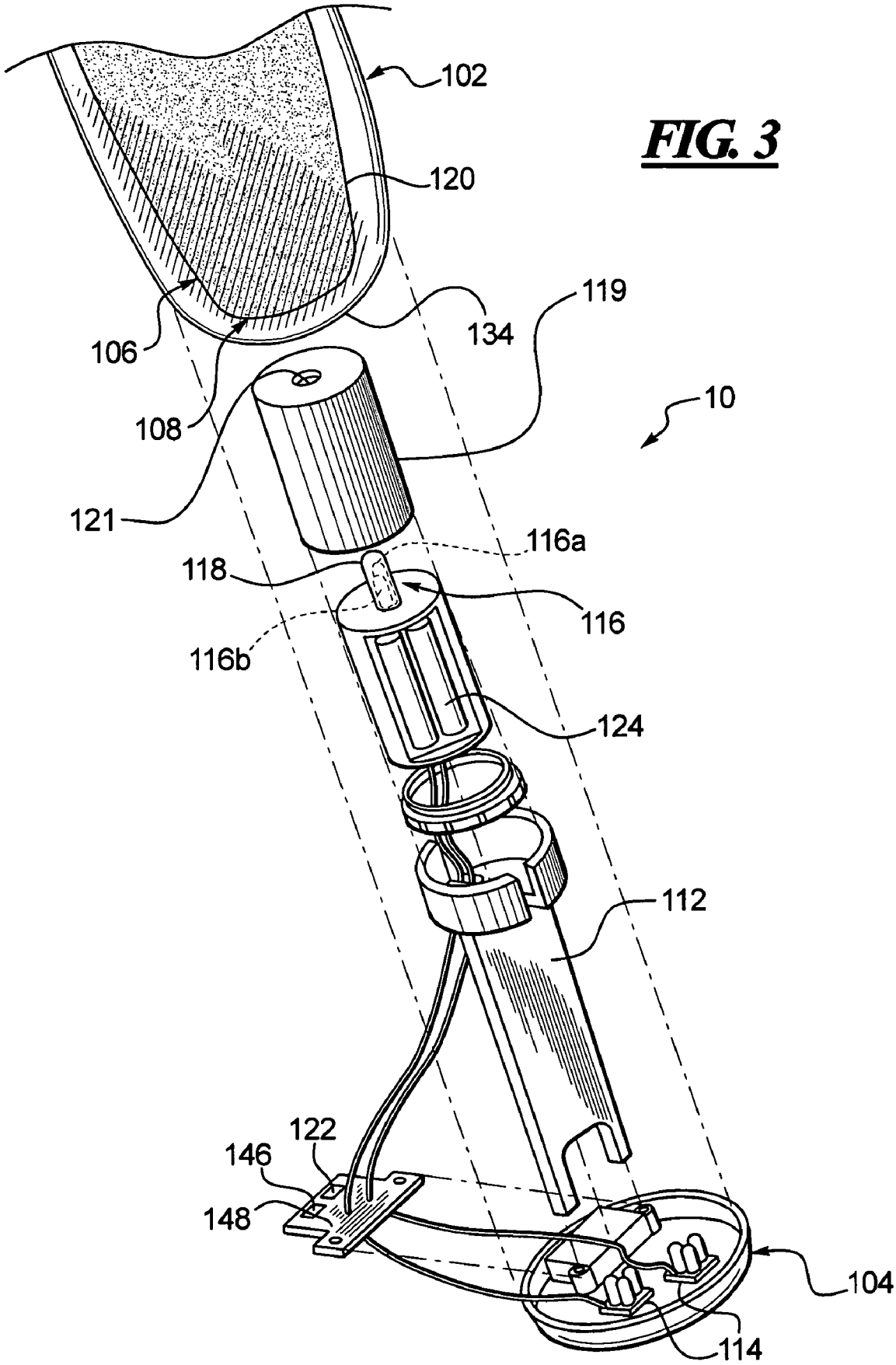
FIG. 3 is an exploded view of the light object of FIG. 1.

As shown in FIG. 3, a first light source 114 is disposed on the base 104 adjacent to the opening 108 in the housing 102. The surfaces of the base 104 that are internal to the device may be coated with a reflecting material, such as a light colored or white coating, a metal foil, a mirrored surface or the like, to enhance the brightness of the light emitted from the first light source 114 and to direct the light upward toward the housing 102. Alternatively, if the base 104 is made of metal, the surface of the base may be polished to provide such a highly reflective surface.

The first light source 114 comprises two arrays of three LEDs each, for a total of six LEDs. Each array is arranged in a triangle shape with one red, one green, and one blue LED. Of course, any number of arrays (including a single array) of LEDs could also advantageously be used, and/or the number of LEDs in each array could be increased or decreased (each array may have as few as two LEDs). Moreover, the arrays of LEDs may be arranged in any shape, such as in a line, circle, square, etc., and need not be arranged in a triangle shape. The first light source 114 is intended to provide a plurality of different preprogrammed light shows, as described in more detail below.

Figure 2:
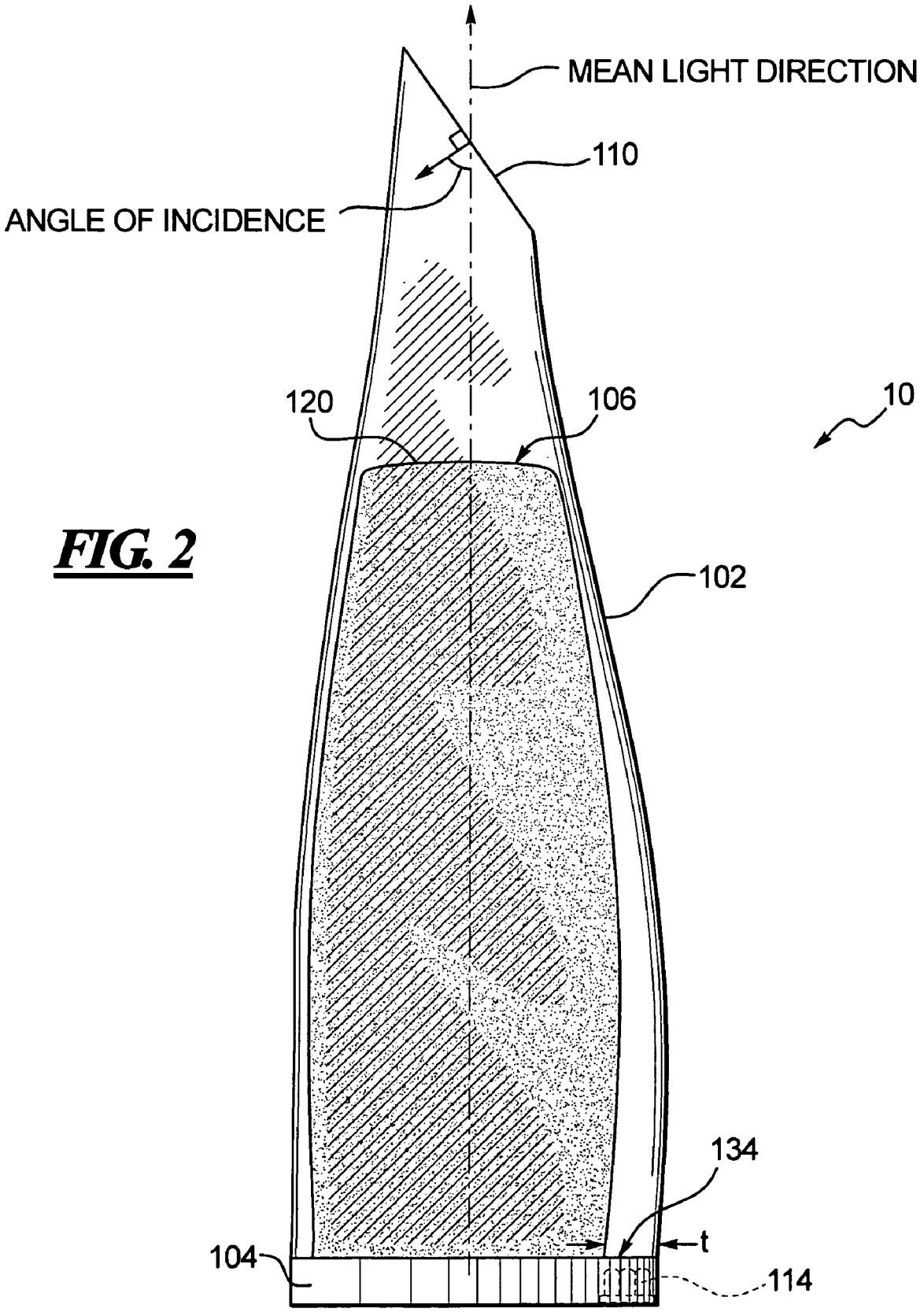
FIG. 2 is a side view of the light object of FIG. 1.

As best seen in FIG. 2, the first light source 114 transmits light via a light interface 134 into a wall of the housing 102 to illuminate the housing 102. The light interface 134 preferably comprises a substantially planar surface 134 on the housing 102 around at least a portion of the periphery of the opening 108 formed by the cavity 106. The thickness t of the housing wall at the light interface 134 is preferably greater than or equal to the thickness of the LED arrays of the first light source 114. As a result, a substantial portion of the light from each of the LEDs in the arrays is equally transmitted into the wall of the housing 102. (Light emitted from an LED is emitted in a solid angle, which is specific to the LED. Thus, light spreads out in a cone shape, the further it is from the LED.) Thus, if the LED arrays are arranged linearly and are located directly adjacent to the light interface 134, the thickness t need only be as great as the thickness of one LED. However, if the LEDs array is spaced apart from the light interface, the light interface is preferably make large enough to receive the cone of light projected from the LED. Theoretically, there is no upper limit on the thickness of the housing wall. Practically, however, wall thickness t is limited by considerations such as size and weight of the light object. Thus, a preferred wall thickness t at the light interface of the light object 10 is in the range of about 0.1 inches (2.54 mm) to about 2.0 inches (50.8 mm), more preferably from about 0.25 inches (6.35 mm) to about 1.0 inches (25.4 mm). However, as noted above, various other wall thicknesses (both larger and smaller) may also be used, depending on design considerations such as the size of the light source, spacing of the light source from the light interface, size and weight of the light object, and the like.

The LEDs of the first light source 114 are oriented adjacent, and substantially normal, to the light interface 134. In this embodiment, the wall thickness t varies between about 0.5 inches and about 0.8 inches along the light interface 134. Accordingly, a majority of the light emitted from the first light source 114 is incident to the substantially planar surface of the light interface 134. As shown in FIG. 2, the angle of incidence is the angle between a light ray incident to the surface and a line normal to the surface. The critical angle is material specific. For glass, the critical angle is approximately 42°, and for polyurethane the critical angle is approximately 45°. These critical angles are not constants and vary somewhat based on the wavelength of the light used, impurities in the materials, and the like. Consequently, a majority of the light emitted from the first light source 114 is transmitted into the wall of the housing 102 at the light interface 134, rather than being reflected. Preferably, the surface of the light interface 134 is a smooth flat surface to maximize the amount of light transmitted into the walls of the housing 102. Alternatively, in some instances, it may be desirable to treat the light interface surface 134 by, for example, sandblasting, etching, coating with a light-diffusing coating, or the like, in order to enhance the diffusion and/or color blending of the light as it enters the wall of the housing 102.

One alternative to placing a light source 114 adjacent to the interface or housing rim 134 is to employ LEDs and optical fibers. For example, the LEDs could be conveniently mounted to the base 104 or printed circuit board (PCB) 148 (see FIG. 3) and fibers would be used to connect the LEDs to the interface 135 or junction between the base 104 and interface 134 or other desired location. It is therefore envisioned that fiber optics can be used as a substitute for the positional relationship between the LED light cluster 114 and the housing 102 illustrated in FIG. 2.

Once light enters the housing wall, it is transmitted through the housing 102. Most of the light intersecting the sides of the housing wall intersects at an angle greater than the critical angle and is, therefore, reflected back into the housing wall, rather than being emitted from the housing. Thus, the wall of the housing 102 essentially functions as an optical waveguide, transmitting a substantial portion of the light within the wall thickness from the first light source 114 at one end of the housing 102, generally in a mean light direction toward a reflecting surface 110 at the other end of the housing 102. Of course, most of the light rays are not actually traveling directly from one end of the housing to the other, but the average direction of light travel through the housing, given as the mean light direction, is from the first light source 114 toward the reflecting surface 110. Moreover, not all of the light in the wall of the housing 102 stays within the wall. Some of the light is allowed to escape and is emitted through the wall of the housing 102.

The reflecting surface 110 comprises a surface oriented such that an angle of incidence of the mean light direction relative to the reflecting surface 110 is at least equal to the critical angle of the housing material (i.e., at least about 42° for a glass housing and at least about 45° for a polyurethane housing). Thus, the reflecting surface 110 reflects a substantial portion (though, by no means all) of light in the wall of the housing 102 that is incident thereto. Alternatively, or additionally, the reflecting surface and/or the entire housing 102 could be coated with a reflective material or a material that alters the critical angle of the housing material to enhance the amount of light reflected by the reflecting surface 110. The reflecting surface 110 reflects light back into the wall of the housing 102, so that the housing 102 is more uniformly and completely illuminated. Of course, some amount of light (i.e., those light rays that are incident to a surface of the housing at an angle less than the critical angle) is preferably emitted from every surface of the housing 102, including the reflecting surface 110.

Figure 19:
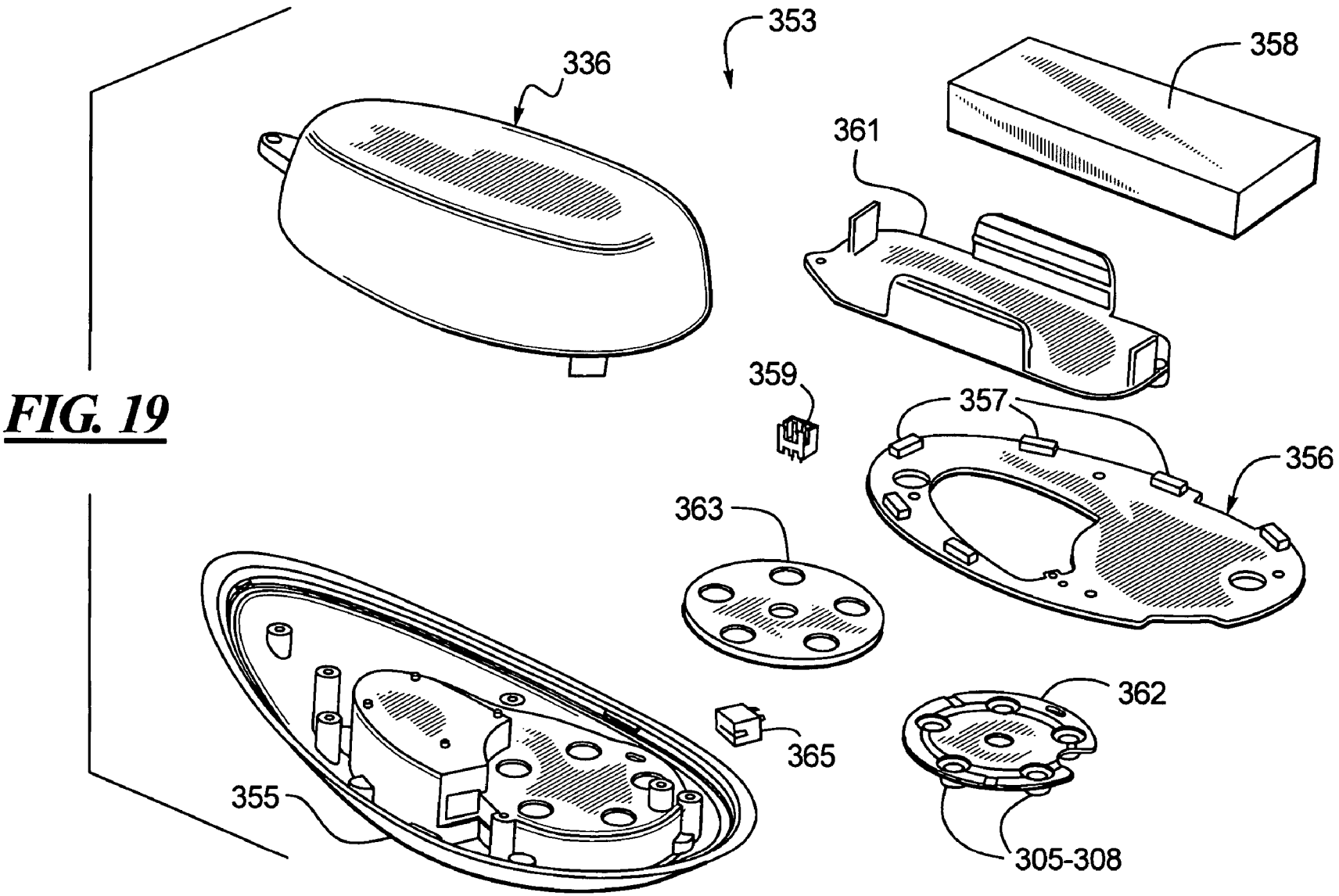
FIG. 19 is a partial exploded view of a light object shown in FIG. 18, without the bowl portion.
Figure 20:
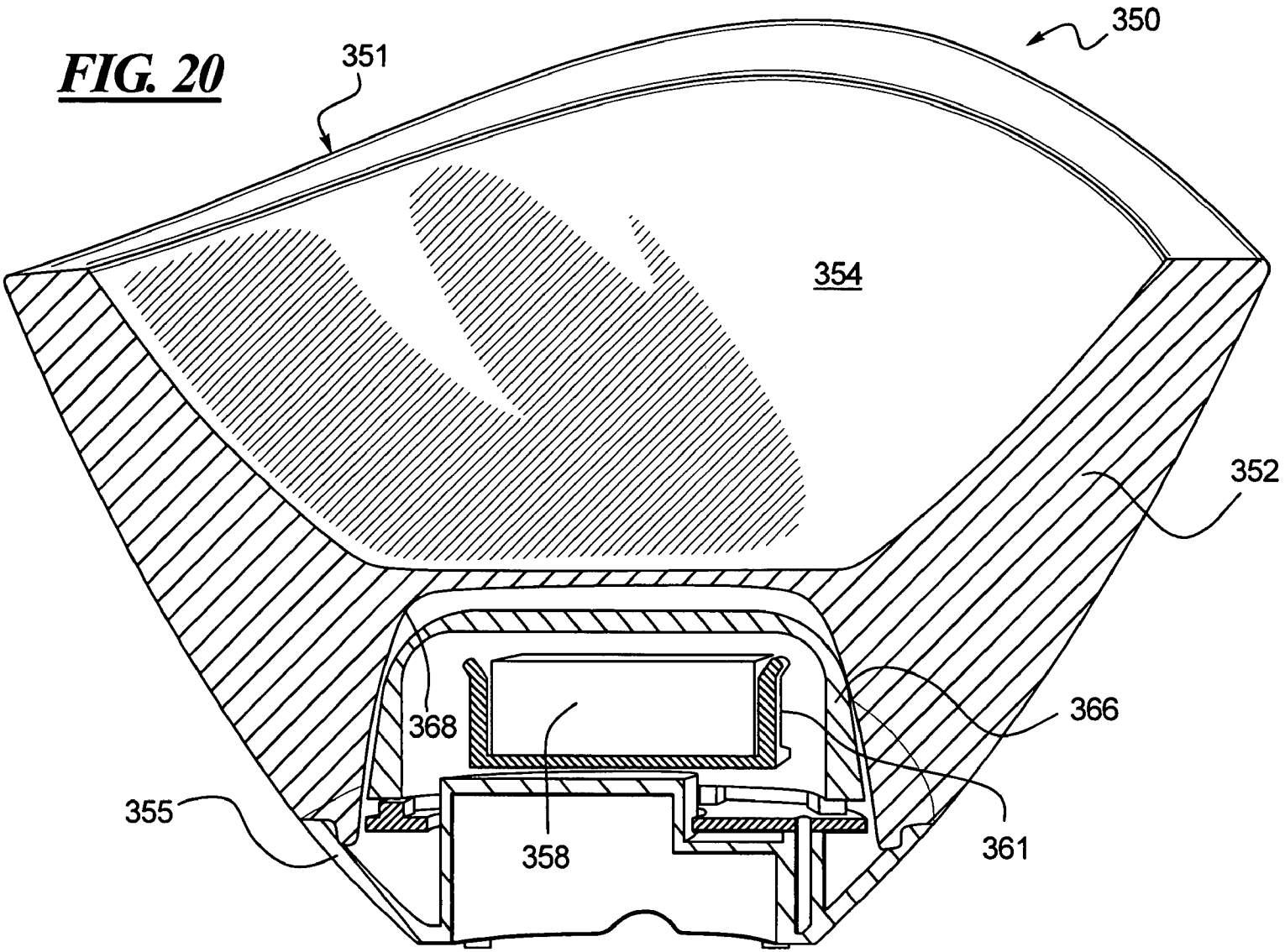
FIG. 20 is a sectional view of the light object of FIGS. 18 and 19.

It will be noted below that the use of the disclosed light pipes 304 (FIGS. 13, 14), 333 (FIGS. 16, 17) and 366 (FIGS. 18-20) below eliminates the need to place a light source at the interface 134 (FIG. 2) as the light is diffused as it leaves the light pipe thereby uniformly illuminating the housing.

As shown in FIG. 3, a second light source 116 is disposed on the protruding portion 112 of the base 104, so as to be received in the cavity 106 of the housing 102 at a location spaced apart from the opening 108 in the housing. The second light source 116 is designed to simulate the appearance of a candle. The second light source 116 preferably comprises a pair of LEDs 116*a*, 116*b*, arranged in a stepped relation to one another. The lower LED 116*b* is preferably always on, while the upper LED 116*a* may be always on (steady illumination mode) or may flash periodically to simulate a flickering candle (flicker illumination mode). The LEDs 116*a*, 116*b* of the second light source 116 are preferably white, yellow, amber, red, orange, or a combination thereof. The operation of the second light source 116 is described more fully below.

A shroud 118 may be employed to cover the LEDs 116*a*, 116*b* of the second light source 116, to diffuse the light and to give the second light source 116 a more realistic candle flame appearance.

FIG. 3 also illustrates the use of a larger shroud or light pipe 119 which can be used to cover the electronic components of the device 10 and can also be used to diffuse light. The shroud or light pipe shown at 119 in FIG. 3 includes an opening shown at 121 for the shrouded light source 116. The shroud 118 could be eliminated, and the shrouder light pipe 119 be extended to fully cover the light source 116. The inner or outer surface of the shrouder light pipe 119 could be scratched or roughened to provide the light-diffusing qualities of the surface 120 of the cavity 106 as shown in FIGS. 1-3. More preferred light pipes are shown in FIGS. 16-20 below.

The second light source 116 transmits light through a wall of the housing 102 to be emitted from the light object 10. The sandblasted, light-diffusing finish applied to the surface 120 of the cavity 106 increases the amount of light from the second light source 116 that is allowed to exit the light object 10 (rather than being reflected back into the cavity 106). This is believed to be due at least in part to the additional surface area created by the sandblasting process.

Referring now to the electronics of the light object 10, as shown in FIG. 3, a printed circuit board (PCB) 148 is provided on the base 104 for connecting the switches 126-132 with the first and second light sources 114, 116. The PCB includes a memory 122 to store a plurality of preprogrammed light shows for display by the first light source 114. As the memory 122, one or more permanent memories may be used. Preferably, the memory 122 comprises a MAXIM™ DS2506-UNW by Dallas Semiconductor (http://www.maxim-ic-.com/) or a Microchip 24LC00, manufactured by Microchip Technologies, of Chandler, Ariz., or an Atmel AT25F512 memory, manufactured by Amtel Corporation, of San Jose, Calif. In other embodiments the memory 122 may be a memory chip or card detachable from the light object and microcontroller, so that the light shows stored therein may be removed and replaced with other memory cards/chips. In this manner, the user can purchase new memories over time, to continually update the light object with new and different light shows.

The PCB 148 also preferably also includes a microcontroller 146 for accessing the memory 122 in response to input to the user interface, and implementing one or more light shows, based on the data stored in the memory 122. Microcontroller 146 preferably comprises an Atmel Mega8 processor, manufactured by Amtel Corporation, located in San Jose, Calif., and may have onboard program memory of its own and/or external program memory containing the other stored logic with instructions for interpreting the light show data stored in the memory 122. However, other processors could alternatively be used. It will be apparent to those of ordinary skill in the art that various other memories and/or controllers can be used depending on various design considerations, such as the amount of memory required, processing speed, size, reprogrammability, and the like.

The plurality of light shows may include the display of various colors, color changes, different speeds of color change, different combinations of displayed colors, and the like. Examples of light shows that can be stored in the memory 122 and the data corresponding thereto, are described in more detail in the related provisional application entitled "Method and Apparatus for Storing and Defining Light Shows". Ser. No. 60/641,441, filed on Jan. 6, 2005, the contents of which are incorporated herein by reference.

Figure 4:
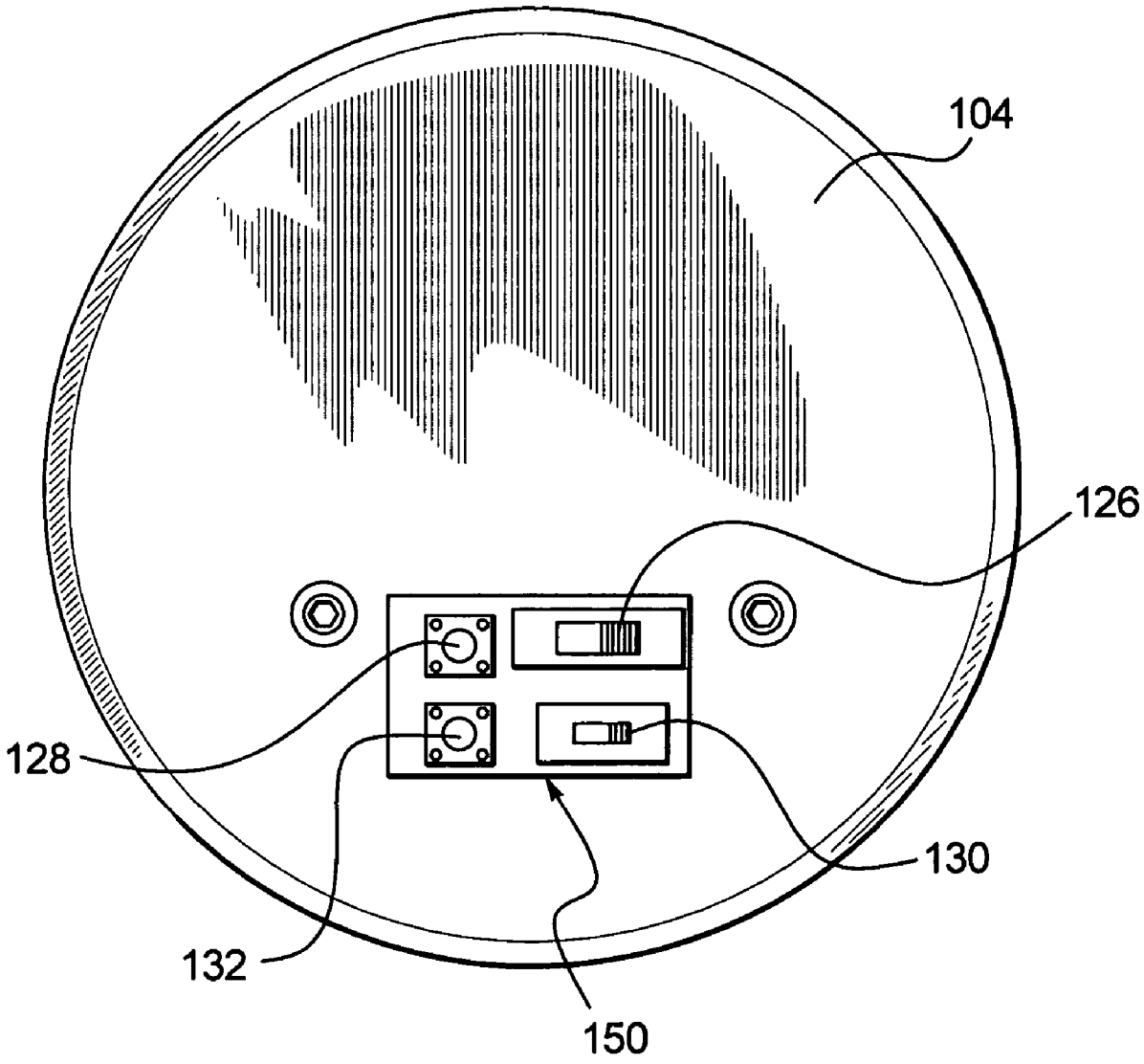
FIG. 4 is a bottom view, showing the user interface of the light object of FIG. 1.

As shown in FIG. 4, a user interface 150 is provided on the bottom surface of the base 104, by which a user can select a desired display setting from among a device OFF setting, at least one light show setting in which the first light source 114 is ON, and at least one illumination setting in which the second light source 116 is ON. The user interface 150 includes a control switch 126, by which the user can select between an OFF position, in which neither of the light sources is activated, a first light source ON position, in which the first light source 114 performs one of the plurality of preprogrammed light shows, and a second light source ON position, in which the second light source 116 is activated.

The user interface 150 also includes a mode switch 128. When the control switch 126 is in the first light source ON position, the user can use the mode switch 128 to select a desired light show to display from among the plurality of preprogrammed light shows stored in the memory 122.

A flicker switch 130 is provided on the user interface 150. When the control switch 126 is in the second light source ON position, the user can use the flicker switch 130 to change between the steady illumination mode (where both LEDs of the second light source are always on) and a flicker illumination mode (where the lower LED 116*b* is always on, while the upper LED 116*a* flickers periodically, or where both LEDs flicker at the same or different frequencies).

A freeze button 132 is also provided on the user interface 150. Using the freeze button 132, when the control switch 126 is in the first light source ON position, the user can freeze a light show that is in progress at a desired point (i.e., color) in the light show.

A conventional auto-shutoff switch 136 may also be provided to turn the light object 10 off after a predetermined period of time without any user input (e.g., shut off after four hours of no change in setting). Any input to the user interface 150 will turn the light object 10 back on. Alternatively, or additionally, a timer used for the auto-shutoff could also be used to cycle through the various preprogrammed light shows and/or illumination modes at predetermined intervals.

Power is supplied to the light object by one or more batteries 146 or a battery pack mounted in the base. Preferably, the batteries 146 or battery pack are rechargeable. Such recharging may be accomplished external to the light object 10, or while the batteries are still installed in the light object 10 by the provision of a conventional in-unit charging apparatus (not shown). Alternatively, power could instead be supplied from a wall socket with the provision of a power cord and a conventional power converter, transformer, and the like.

Circuit diagrams corresponding to one disclosed light object are shown in FIGS. 8-12. These circuits can be advantageously adapted for use with any of the embodiments and features described herein, and can be readily modified to incorporate various alternatives and variations, as will be apparent to those of ordinary skill in the art.

Figure 5:
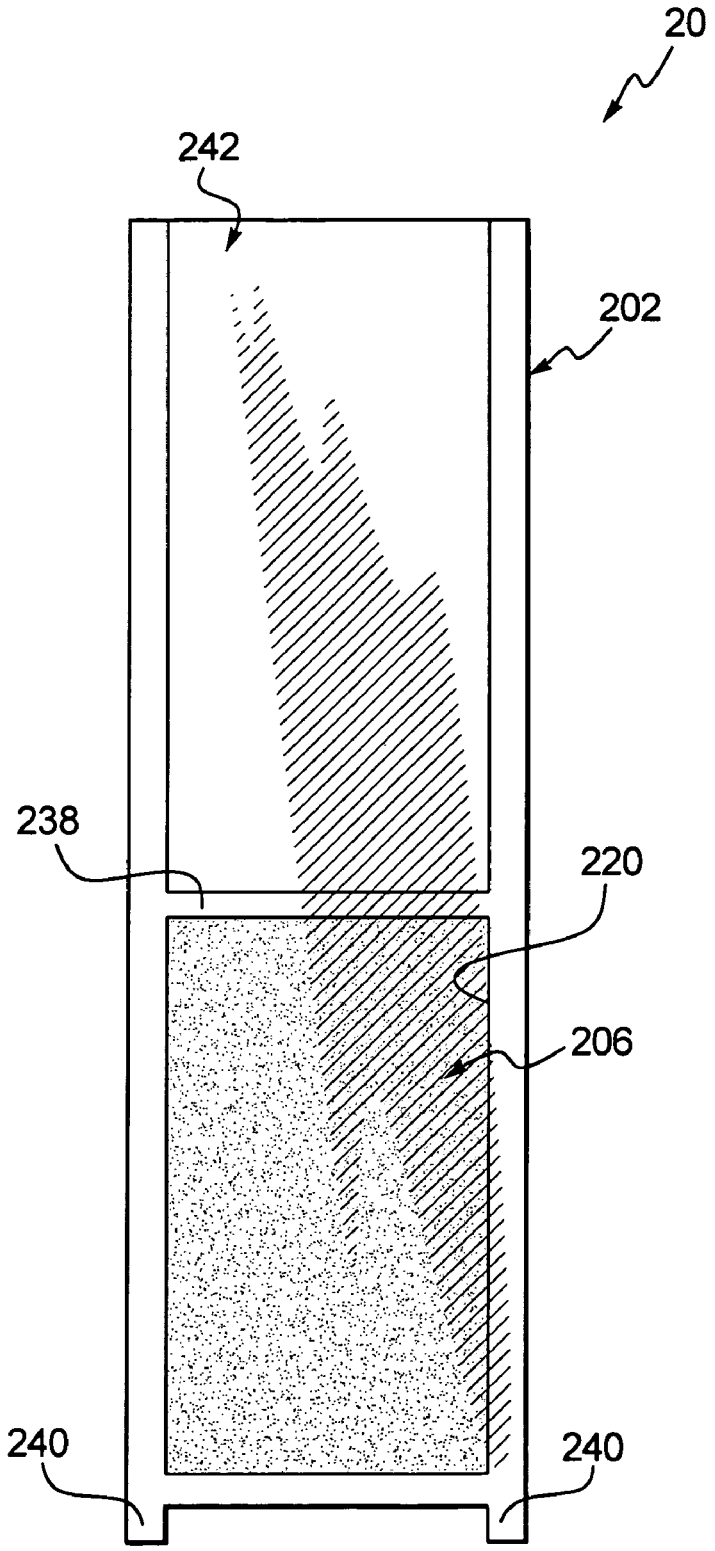
FIG. 5 is a side view of a light object according to another disclosed embodiment.
Figure 6:
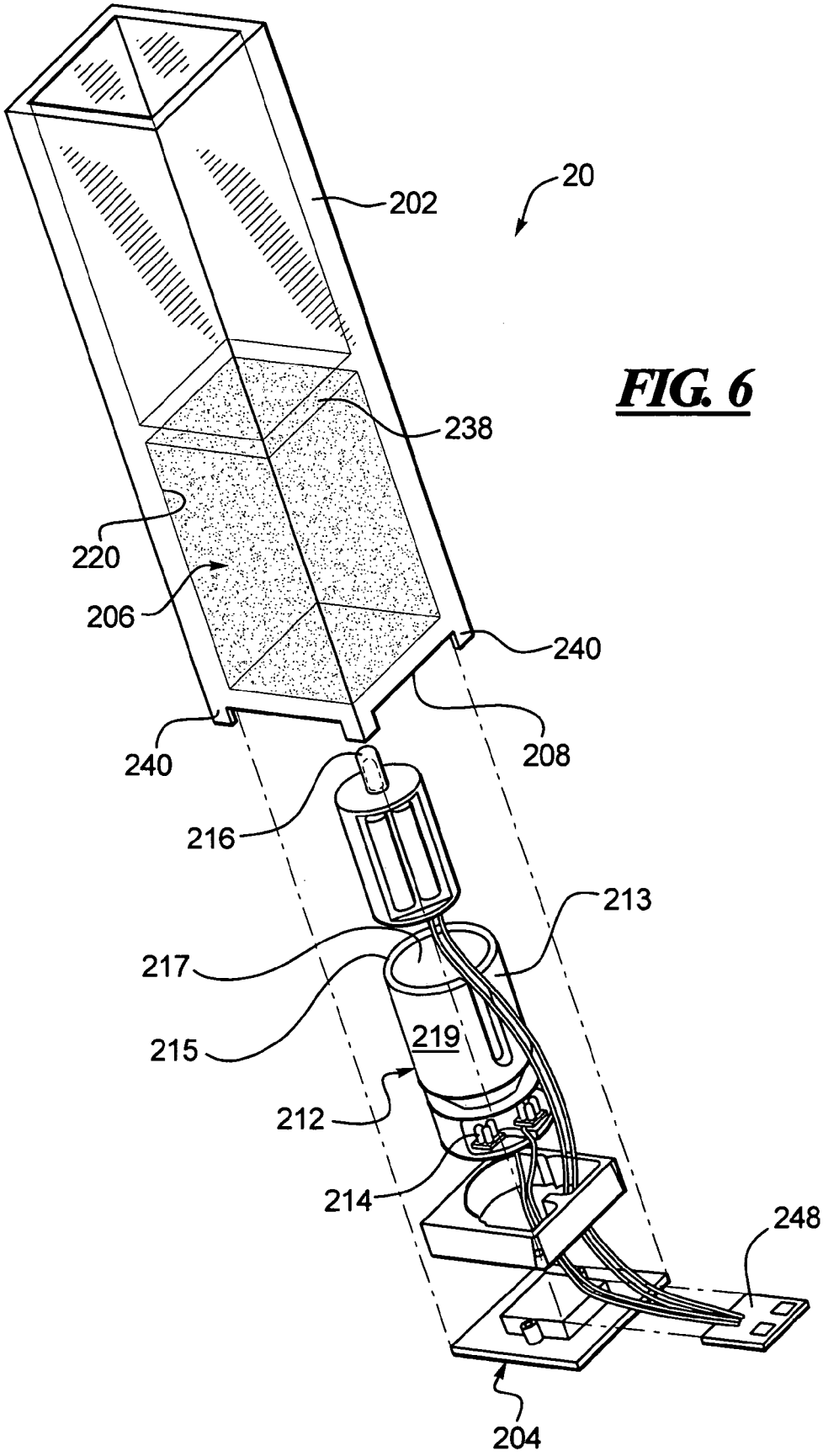
FIG. 6 is an exploded view of the light object of FIG. 5.
Figure 7:
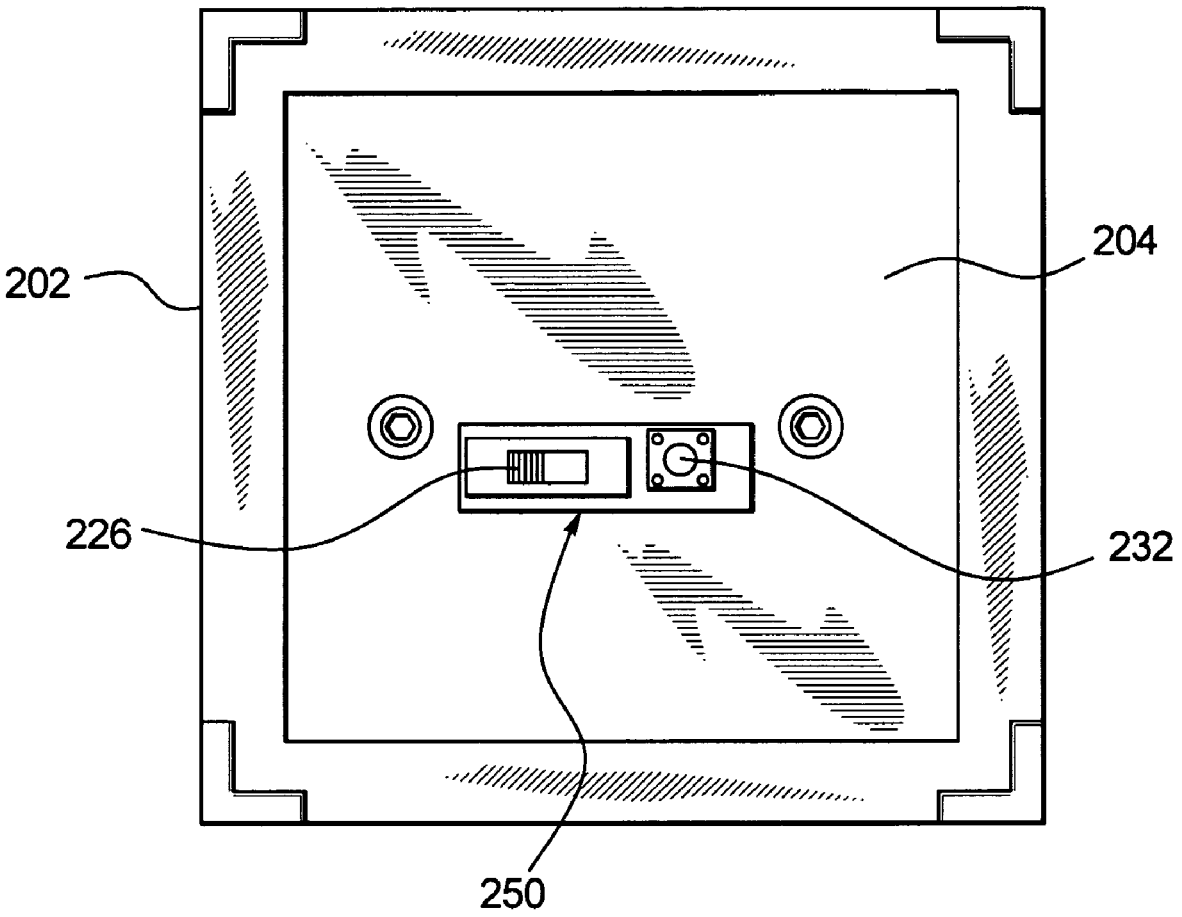
FIG. 7 is a bottom view, showing the user interface of the light object of FIG. 5.

A tower light object 20 according to another embodiment is shown in FIGS. 5-7. This embodiment includes many of the same features as described with respect to the aforementioned curved light object 10. Accordingly, only those features of the tower light object 20 that differ from the curved light object 10 will be described.

The tower light object 20 generally comprises an elongated square housing 202 with a base 204 attachable thereto. In this embodiment, as best shown in FIG. 5, the housing 202 is hollow, except for a shelf 238 provided near the middle of the housing 202. The shelf 238 forms a cavity 206 below, and a receptacle 242 above for holding objects to be displayed, such as flowers, beads, marbles, rocks, etc. The housing has four legs 240, one at each bottom corner of the housing 202. An interior surface 220 of the cavity 206 again includes a light-diffusing surface.

As shown in FIG. 6, the base 204, like that of the previous embodiment, covers an opening 208 in the bottom of the housing 202 defined by the cavity 206. The base 204 includes an upwardly protruding cover or light pipe 212 that fits within the cavity 206. In this embodiment, the light pipe 212 includes a sidewall 213 and an open top 215. Preferably, the light pipe includes a roughened inner surface 217 or a roughened outer surface 219 to serve two purposes. First, the roughened light pipe can serve as a light diffuser which helps the lighted object to "glow." Second, the roughened light pipe can effectively hide the electrical components such as the lights 214 and PCB 248.

In this embodiment, however, the first light source 214 is located on the protruding portion 212 of the base. With this arrangement, when the first light source is activated, the cavity 206 is illuminated to display one or more light shows, rather than the light being transmitted into the wall of the housing as in the first embodiment. This arrangement enhances the display of an object held in the receptacle 242. Additionally, since a substantial amount of light is not being transmitted into the wall of the housing 202, the provision of a reflecting surface can be omitted in this embodiment.

The first and second light sources 214, 216 are the same as those described with respect to the first embodiment. To further enhance the light emitted from the first light source 214, one or more reflectors (not shown) may be positioned behind the LED arrays of the first light source 114 to reflect more of the light outward and/or upward. Such reflectors may comprise a light-colored or white panel, a metal foil surface, a mirrored surface, or the like.

Another difference in this embodiment is the construction of the user interface 250. In this embodiment, as shown in FIG. 7, the user interface 250 comprises a single control switch 226 that performs the functions of the control switch 126, the mode switch 128, and the flicker switch 130 of the previous embodiment. That is, the control switch 226 allows the user to select between an OFF position, in which neither of the light sources is activated, a first light show position, in which the first light source 214 performs a first preprogrammed light show, a second light show position, in which the first light source 214 performs a second preprogrammed light show, a third light show position, in which the first light source 214 performs a third preprogrammed light show, a steady illumination mode, in which both LEDs 216*a*, 216*b* of the second light source 216 are always on, and a flicker illumination mode, in which the lower LED 116*b* of the second light source 216 is always on, while the upper LED 116*a* flashes periodically. A separate freeze button 232 and an auto-shutoff (not shown) are preferably still provided, just as in the first embodiment.

Figure 8:
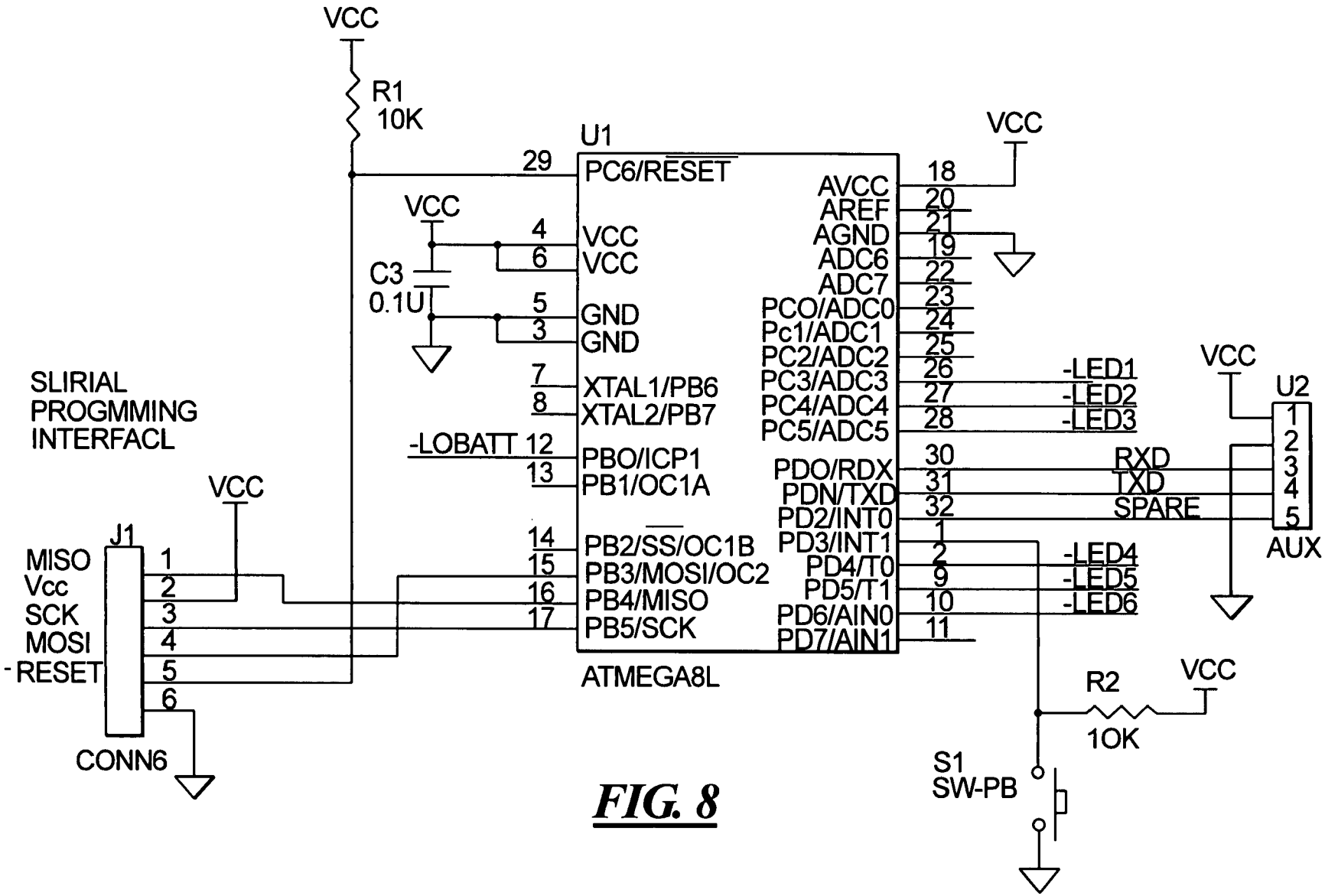
FIG. 8 is a circuit diagram corresponding to the light object of FIG. 1.

FIG. 8 shows a microcontroller U1 configured to operate one or more predetermined light shows stored in an internal memory. The circuit includes a programming port J1 that may be used to reprogram the internal memory of the microcontroller U1 to allow for the light shows to be changed at a later time. The AUX connector J2 is provided to interface with external memory as required. The switch S1 may be configured as either a mode switch or a freeze switch. It is understood that additional switches may be added to the circuitry on any of the unused port pins of the microcontroller. The connections labeled –LED1 to –LED6 connect to the LEDs shown in FIG. 10. VCC represents the voltage supplied by the power source.

Figure 9:
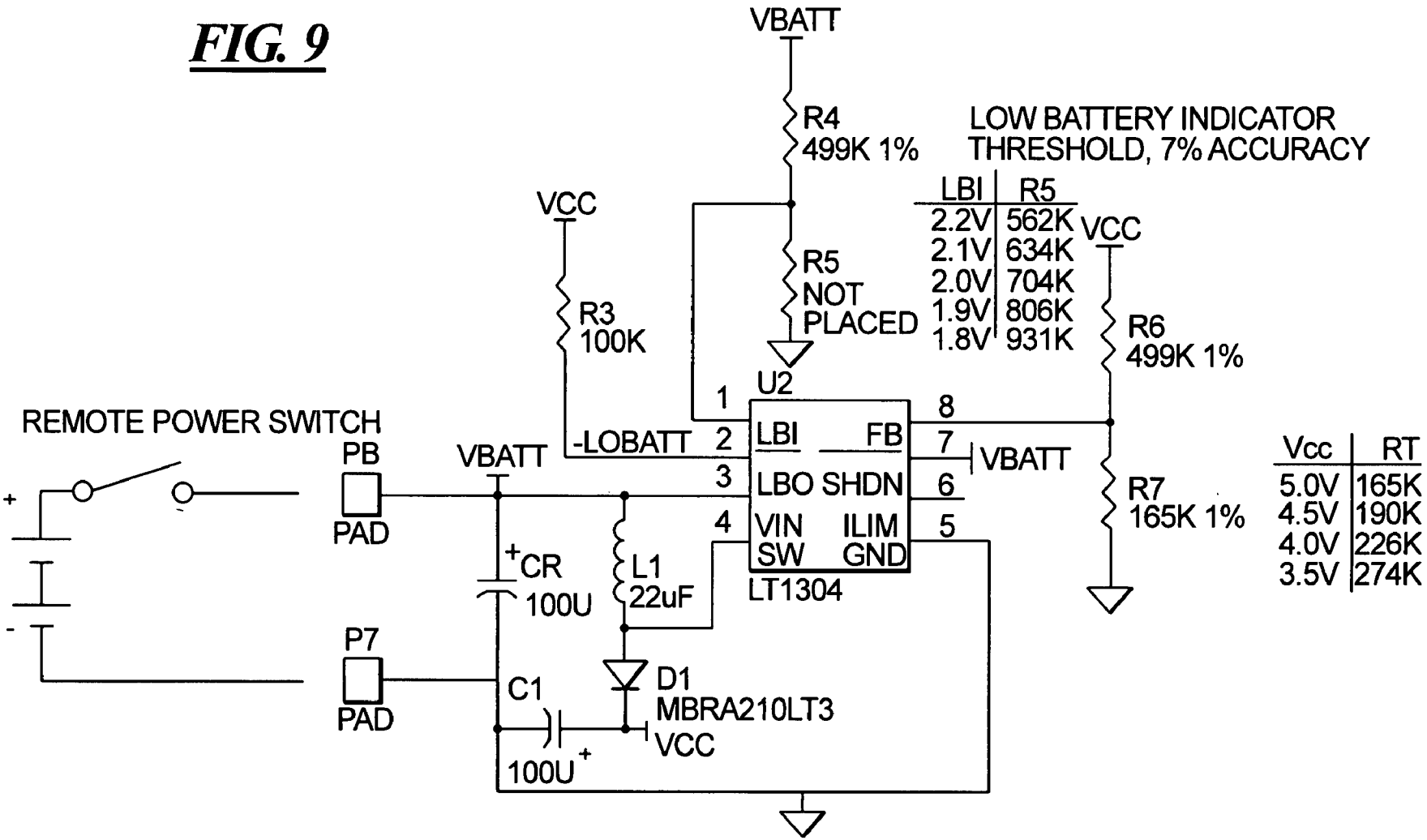
FIG. 9 is a circuit diagram corresponding to the light object of FIG. 1.

FIG. 9 is a circuit diagram of a power supply for a disclosed light object. The circuit takes battery input from P7 and P8 and boosts it to a voltage defined by resistor R7. Preferably this voltage is set to 5 Volts DC; however, other voltages could be used depending on design considerations, such as the power needs of other circuit components, or the like. The circuit also contains a low battery detect function that is capable of providing the microcontroller U1 a shut down signal when the batteries have been discharged to below a predetermined level. This level may be set by adjusting the resistance of resistor R5.

Figure 10:
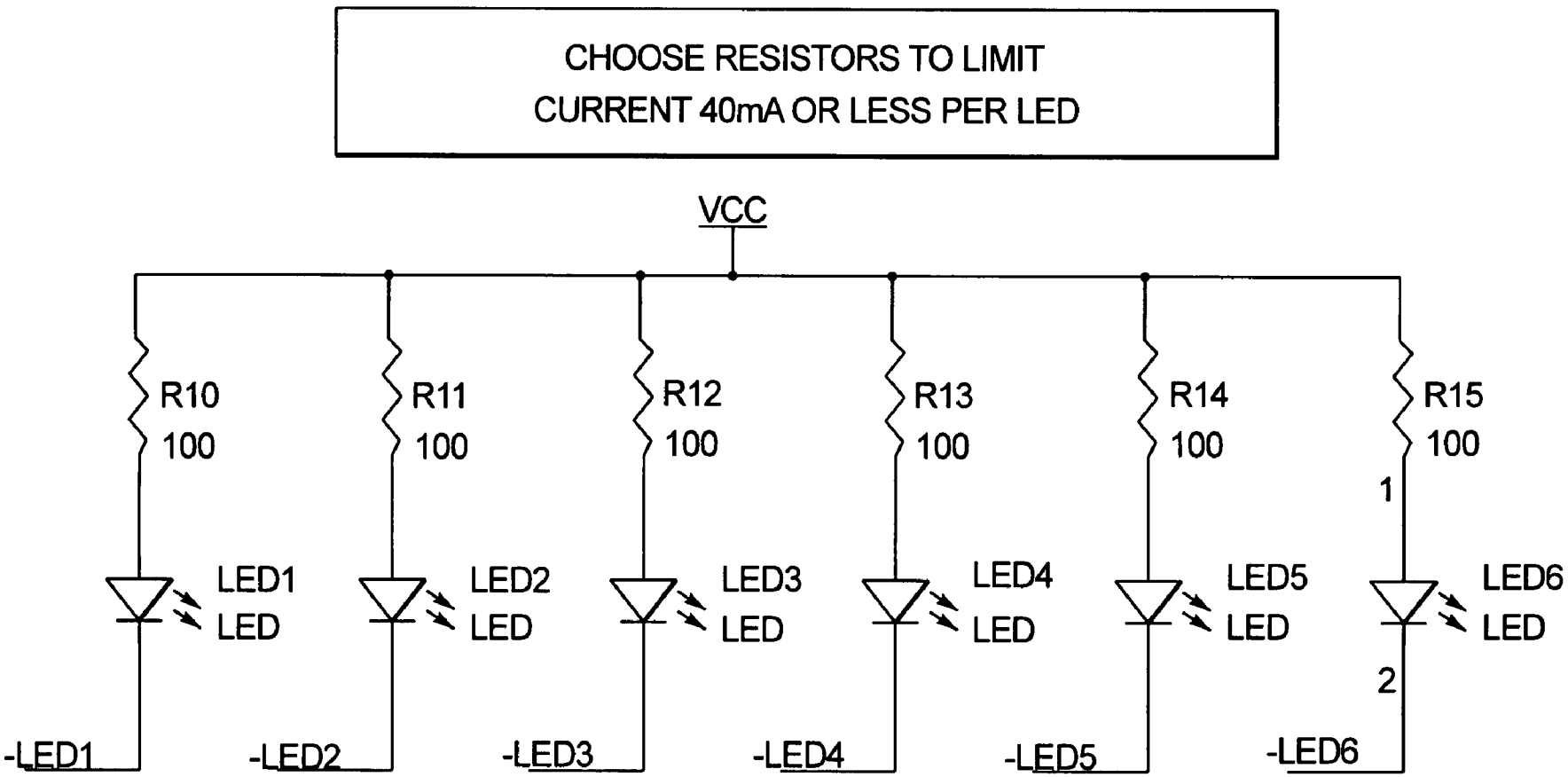
FIG. 10 is a circuit diagram corresponding to the light object of FIG. 1.

FIG. 10 is a circuit diagram depicting the LEDs connected to the LED connections LED1-LED6 in FIG. 8. Multiple LEDs of various colors may be connected to the circuit, as described in detail above with respect to the first embodiment. Resistors R10-R15 connected between LED1 to LED6, respectively, and VCC are used to regulate the maximum current to the LEDs. Each LED is turned on when the respective line labeled –LED1 to –LED6 is connected to the system ground. In this example, the lines are connected to output pins on the microcontroller U1 in FIG. 8. When the microcontroller U1 sets the output port pin to ground, the corresponding LED turns on. Likewise, if the output port pin is set to high, the corresponding LED is turned off.

Figure 11:
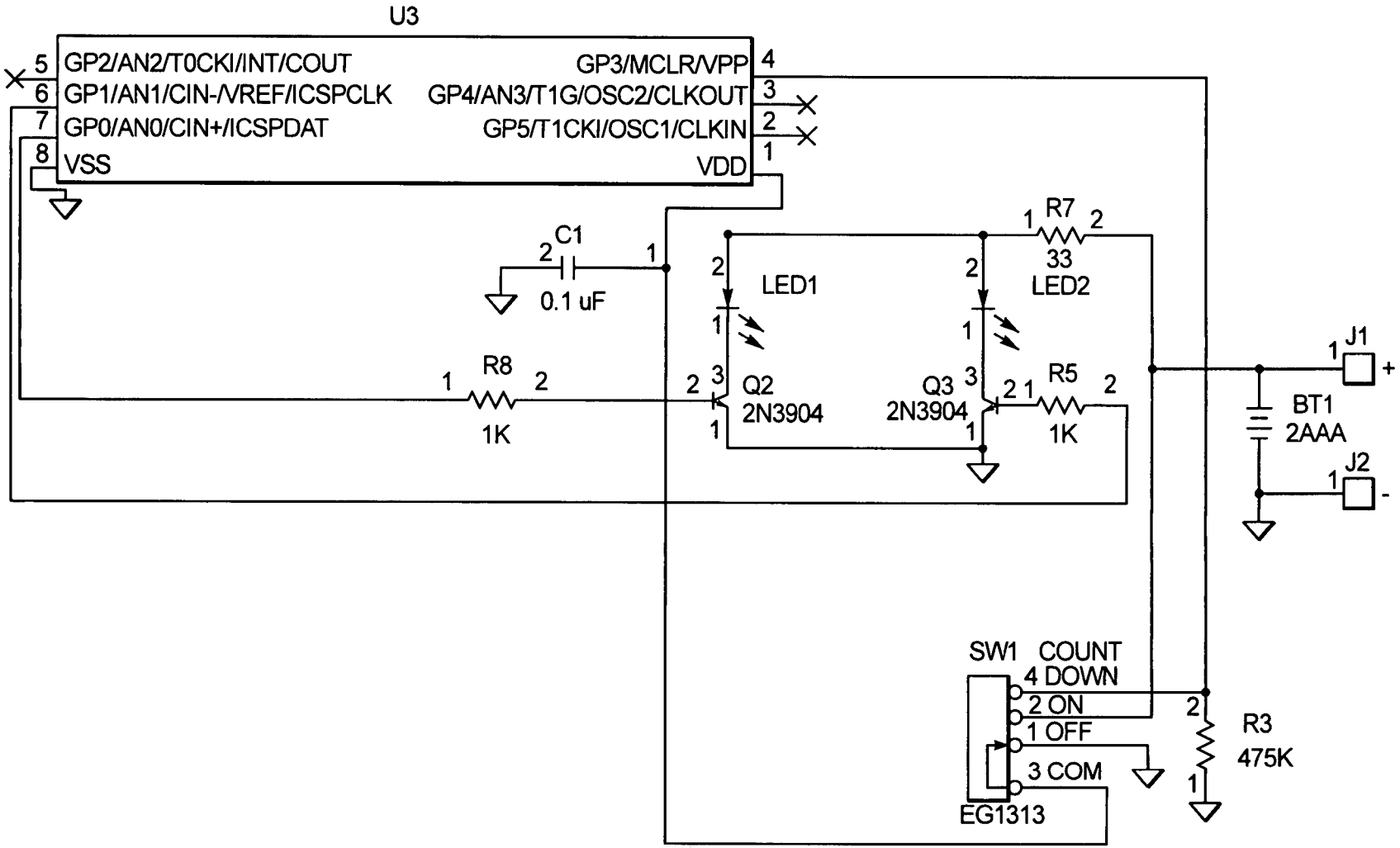
FIG. 11 is a circuit diagram corresponding to the light object of FIG. 1.

FIG. 11 shows a circuit that is used to generate a flicker mode using two LEDs. The circuit contains a microcontroller U3 that has been programmed to generate a seemingly random flicker effect. The LEDs are powered by batteries BT1 connected through resistors R7 and R5. These resistors may be adjusted to control the maximum current through the LEDs. Transistors Q2 and Q3 act as switches to control LED1 and LED2 respectively. The microcontroller U3 is able to turn on or off each LED independently by controlling the signal to the base of the transistors Q2 and Q3. Preferably the microcontroller U3 is configured to leave LED2 on continuously, while turning on and off LED1 in a pseudo random fashion. The switch SW1 is used to turn the device on in a continuous mode or in an auto shut-off mode. The device is powered by batteries BT1 connected at J1 and J2. Of course, one of ordinary skill in the art will recognize that many of the features of the foregoing circuits can be combined into a single circuit, divided into separate circuits, be configured to share one or more components, and/or to add one or more additional switches, sensors, light sources, or the like. For example, in one preferred alternative, the microcontrollers U1 and U3 can be combined into a single microcontroller capable of performing the functions of both microcontrollers.

Figure 12:
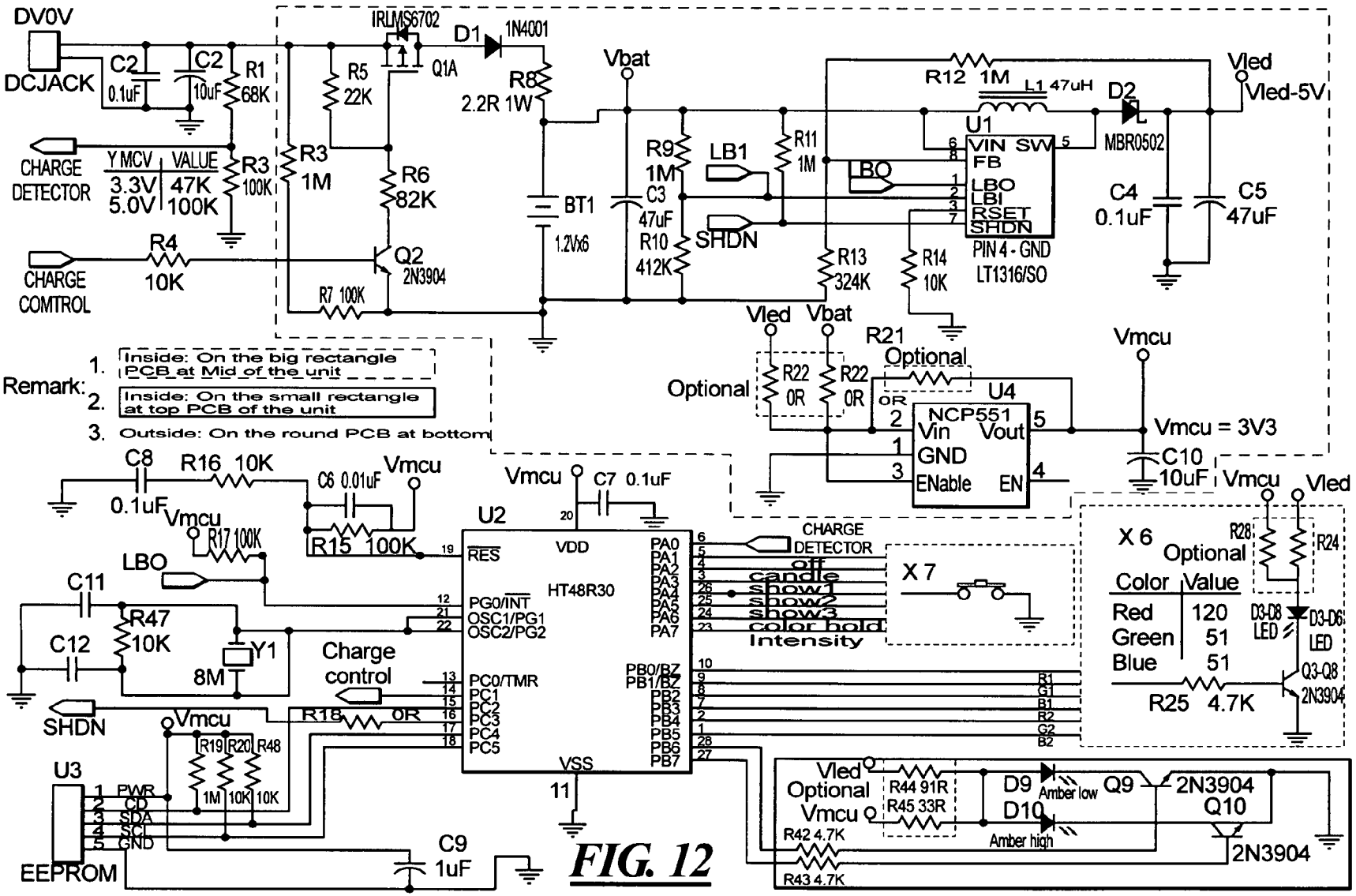
FIG. 12 is a circuit diagram corresponding to the light objects shown in FIGS. 13-24.

FIG. 12 shows a microcontroller U2 configured to operate one or more predetermined lights shows stored in memory cards. Buttons for the interface (see FIGS. 13 and 14) are shown at X7. The circuitry for each LED is shown at X6. The flicker module is connected to the microcontroller U2 at the connections labeled 27, 28. Memory cards connect to the device at U3 thereby enabling the light shows of the device to be altered or substituted. FIG. 12 shows the connections 1, 2 and 7-10 for two RGB LED arrays. The circuit portion for the power supply is shown at the top of FIG. 12 and may be disposed on a separate printed circuit board (PCB). The flicker controls may also be disposed on a separate PCB and the circuitry for the microcontroller U2 and buttons may be disposed on a separate PCB associated with the interface. The circuits of FIG. 12 can be adapted for use with various embodiments and may be readily modified to incorporate additional alternatives and variations.

Figure 13:
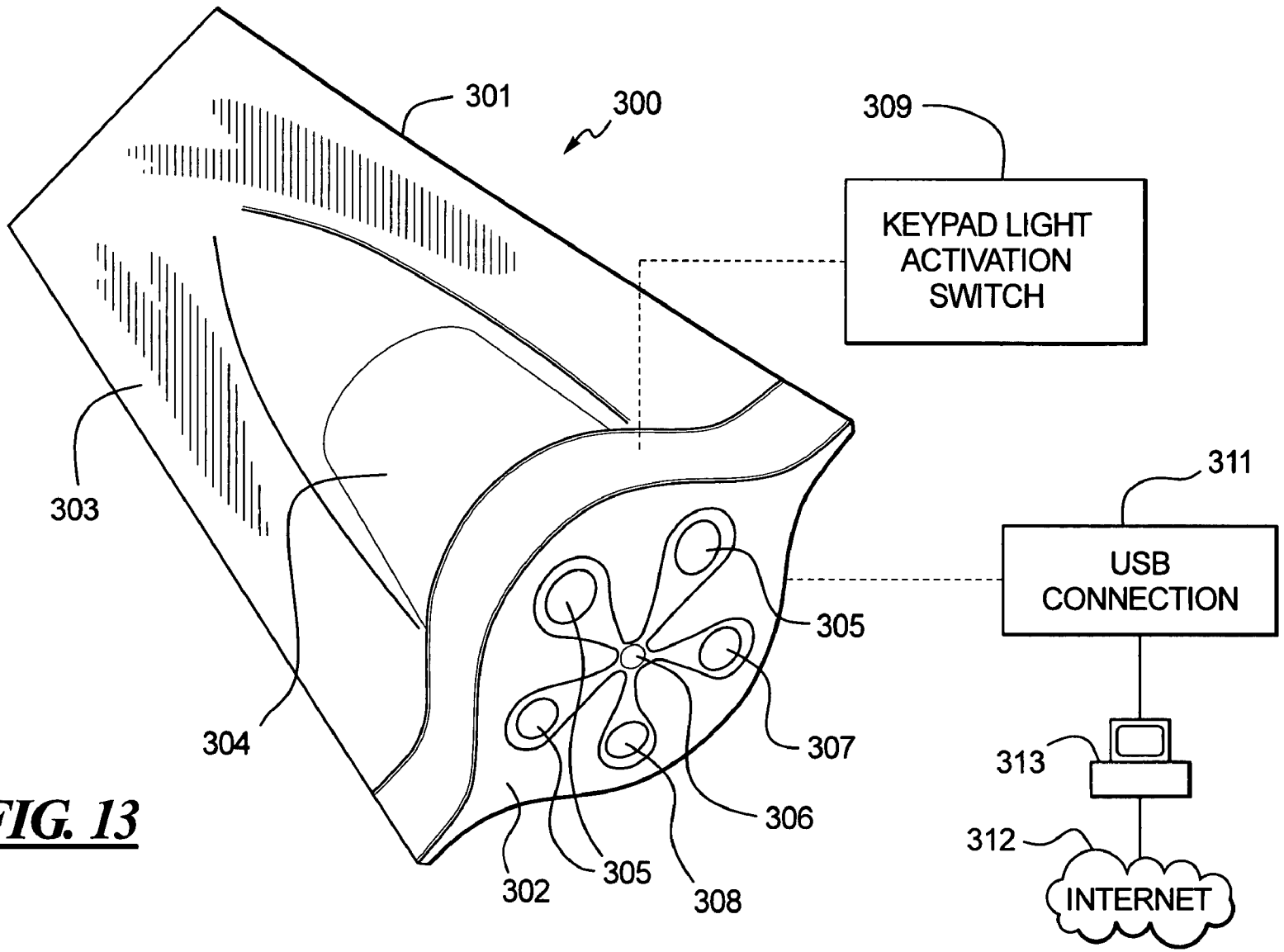
FIG. 13 is a bottom perspective view of a light object according to another disclosed embodiment.

Turning to FIG. 13, a light object 300 is illustrated that includes a housing 301 and a base 302 that comprises an interface. The housing 301 includes a cavity 303 which accommodates a light pipe 304. The design of such light pipes will be discussed in greater detail below in connection with FIGS. 15-20. The interface includes six buttons including three "program" buttons 305, a pause button 306, a flicker button 307 and an ON/OFF button 308.

Preferably, the base/interface 302 includes a background light (not shown). The background light for the buttons 305-308 should be motion activated, or when the object 300 is inverted to press a button 305-308 on the interface 302. In one embodiment, a mercury switch or motion activated switch shown in phantom at 309 is included. Another option is a USB connection 311 for downloading additional light shows from the Internet 312 or from a personal computer 313. It is envisioned that an USB plug is connected to a computer 313 and light shows are downloaded from a website over the Internet 312 and into the interface 302. Such a system would enable a user to modify the light shows of the light object 300 without removing or altering the permanently mounted interface 302.

Figure 14:
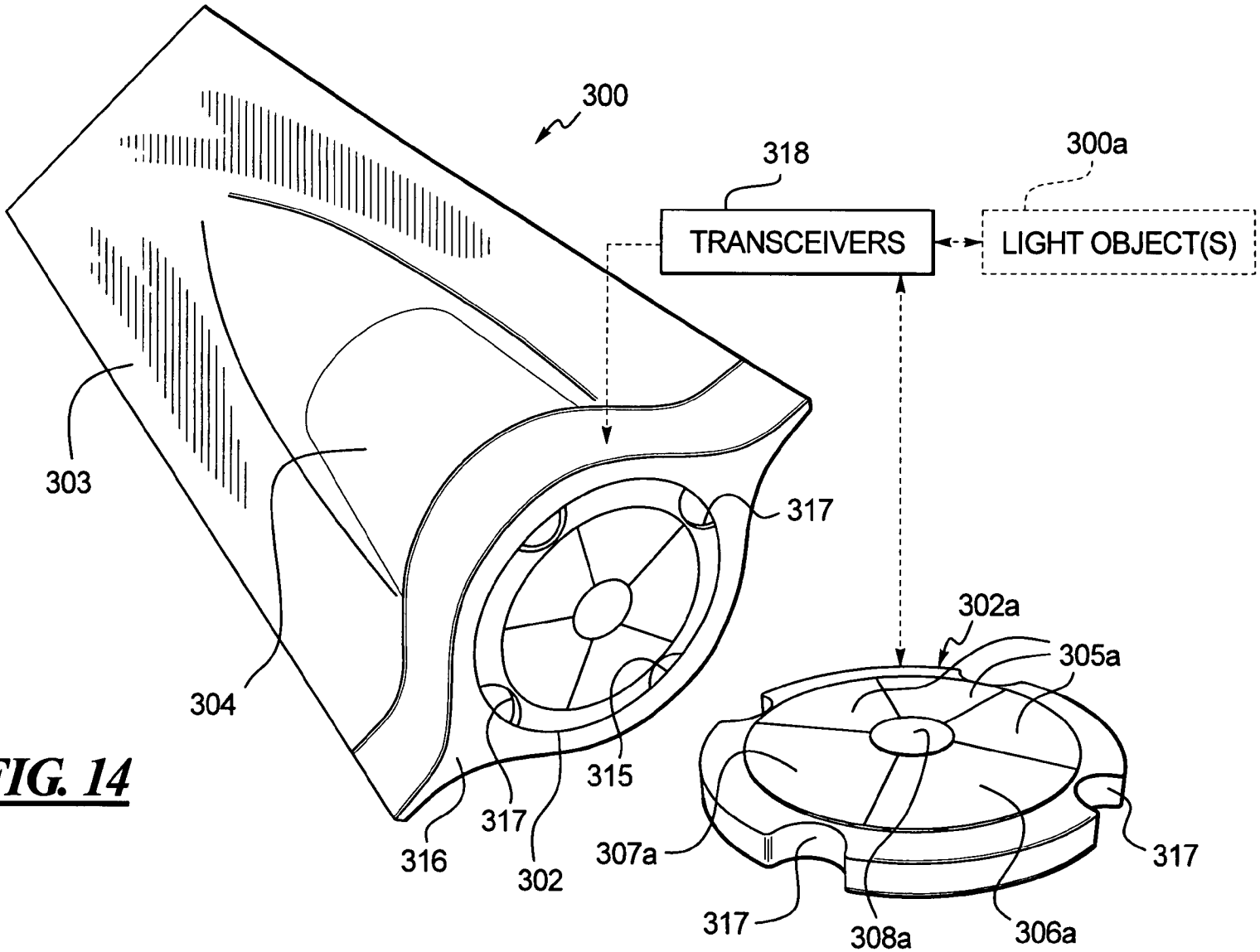
FIG. 14 is a bottom perspective view of a light object and removable remote-control-type interface of yet another disclosed embodiment.

Instead of a permanently mounted interface 302 as shown in FIG. 13, FIG. 14 illustrates a removable wireless interface 302*a*. The interface 302*a* includes a button configuration similar to that shown in FIG. 13, although with a different design. The interface 302*a* fits into a recess 315 disposed in the base structure 316 which is essentially a frame. The interface 302*a* also includes recesses 317 to facilitate removal of the interface 302*a* from the base frame 316.

Thus, the interface 302*a* is a wireless interface and therefore the circuitry of the interface 302*a* and that of the object 300*a* includes transceivers 318 for wireless communication. Thus, the interface 302*a* is essentially a remote control. Further, in an embodiment, transceivers 318 are used to communicate between light objects 300*a*. Using synching technology that is known in the art (see, e.g., U.S. Pat. Nos. 6,801,003 and 6,777,891, both of which are incorporated herein by reference), the light shows provided by each object 300*a* can be synchronized with each other and/or coordinated with each other. In the embodiment shown in FIG. 14, transceivers may be required in both the interface 302*a* and within the circuitry (not shown) of the light object 300*a*. Further, two interfaces 302*a* may be employed with a light object 300*a*. Specifically, a permanently-mounted interface 302*a* may be disposed within the base frame 316. Further, a removable remote-control-type interface 302 may be detachably mounted over the permanently installed interface (not shown). Thus, if the removable remote-control-type interface 302*a* is removed and lost, a permanently-mounted interface remains with the light object 300*a* so that the light object 300*a* is still fully functional even the remote-control-type interface 302*a* has been lost.

Figure 15:
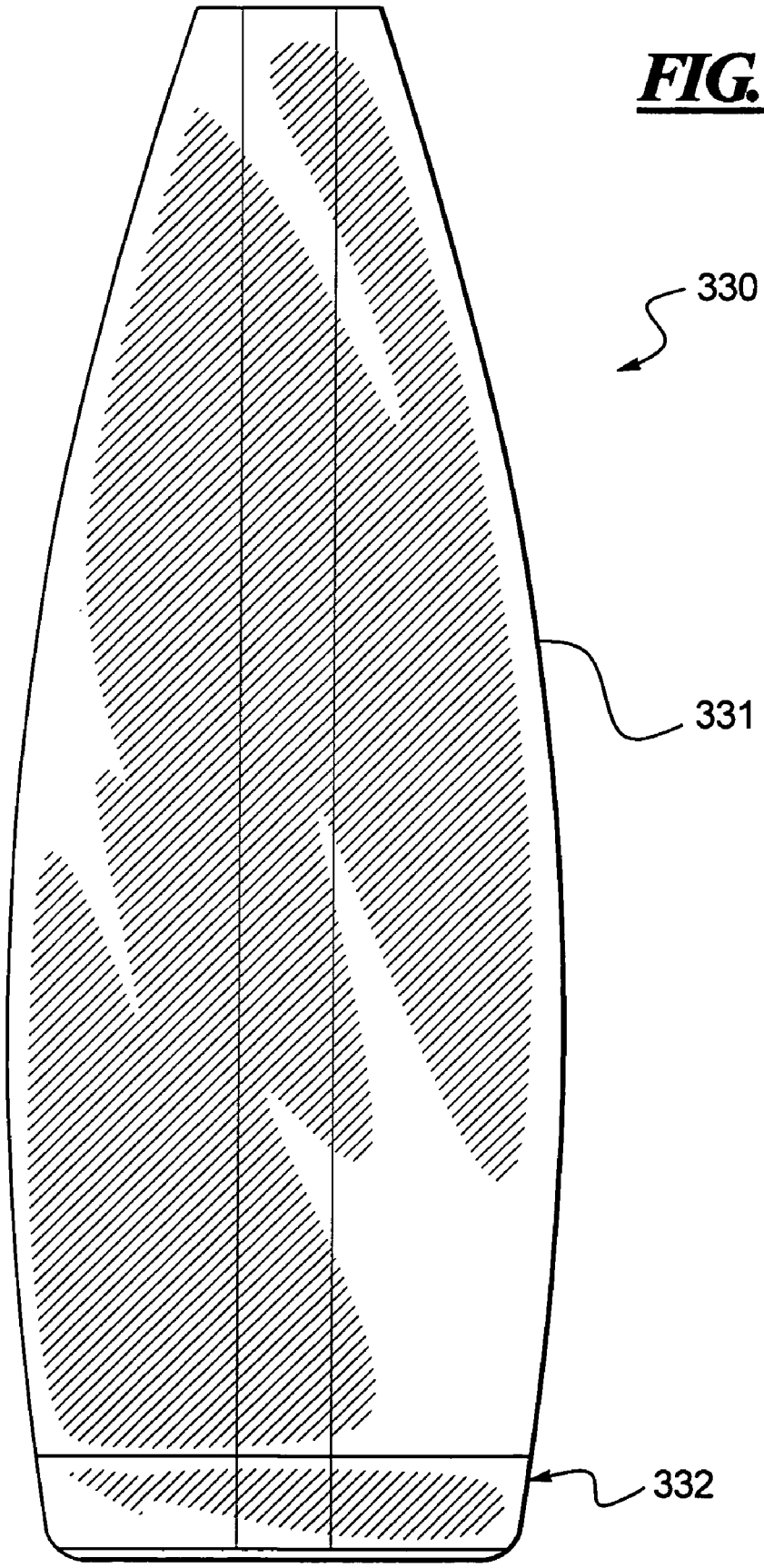
FIG. 15 is a front plane view of a light object according to yet another disclosed embodiment.
Figure 16:
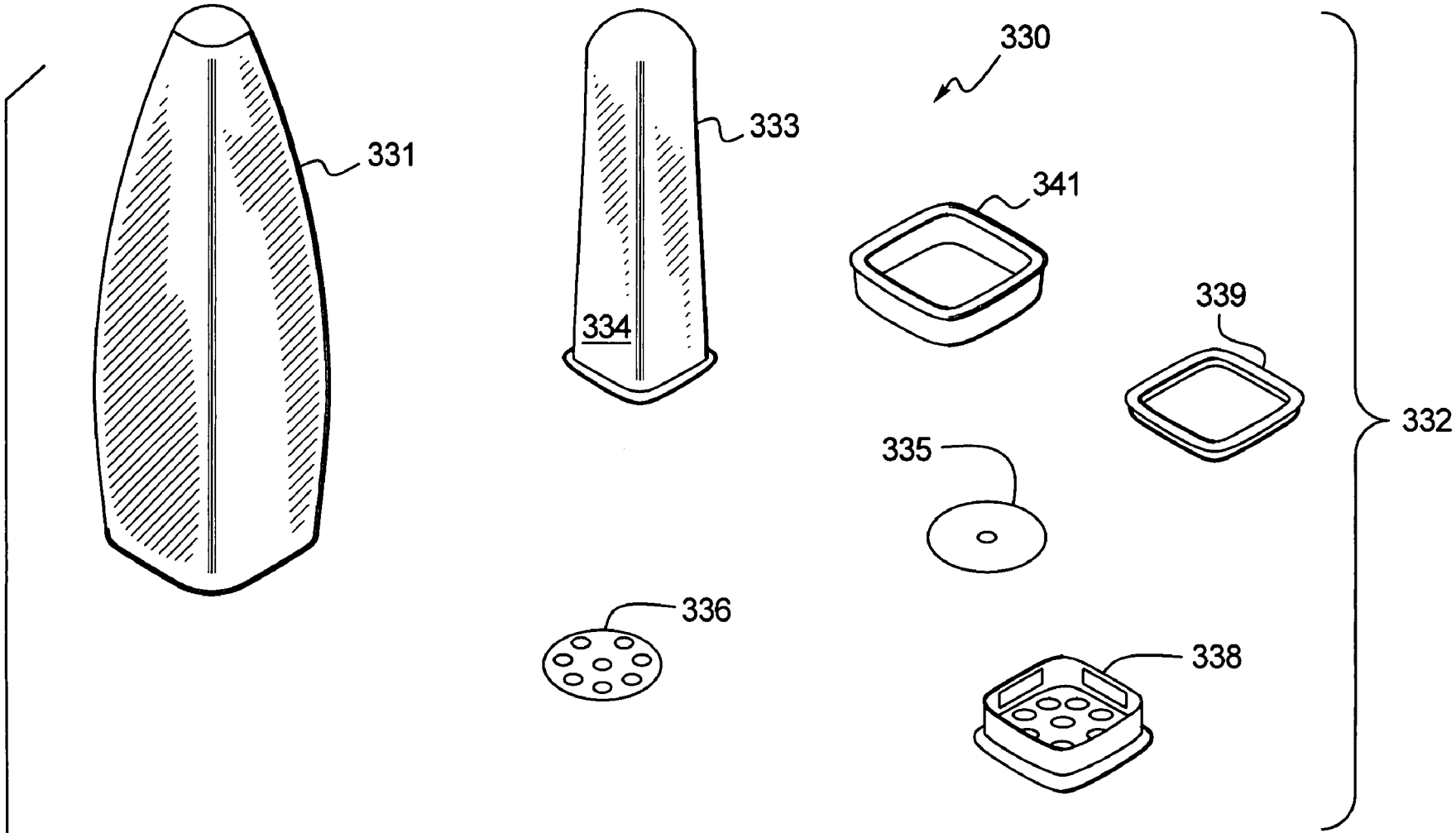
FIG. 16 is an exploded view of a light object of FIG. 15.
Figure 17:
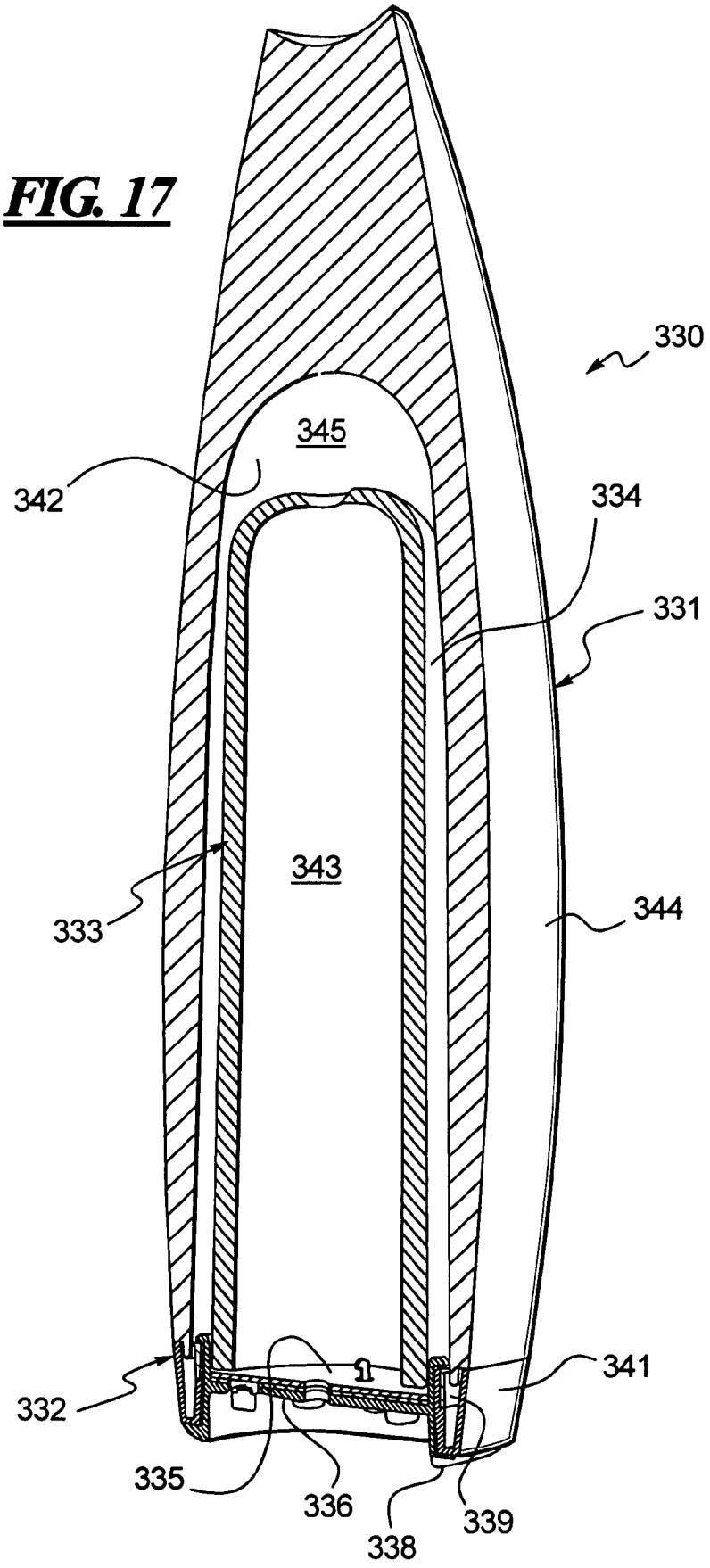
FIG. 17 is a sectional view of the light object shown in FIGS. 15 and 16.

Turning now to FIGS. 15-17, an alternative light object 330 is disclosed. The light object 330 includes a vertically oriented outer housing or shell 331 and a lower supporting base shown generally at 332 in FIG. 15.

As shown in FIG. 16, the housing 331 encloses a light pipe 333 which covers the electronic circuitry and provides lambertian or near-lambertian light diffusion. Specifically, the outer surface 334 of the light pipe 333 is preferably roughened, such as by sandblasting, to form a lambertian or near-lambertian surface that effectively diffuses light. Light is generated by RGB LED clusters disposed on the board 335. Beneath the board 335 is a button or interface plate 336. The board 335 and button plate 336 are supported within an interface housing 338 which, in turn, is supported within a base retainer 339 and outer base frame 341. The combined circuitry disposed on the board 335 and interface button board 336 are illustrated in FIG. 12 above. The relationship between the mechanical parts shown in FIG. 16 are further illustrated in FIG. 17.

Turning to FIG. 17, the outer shell 331 defines an inner cavity 342. The inner cavity 342 provides a space for accommodating the light pipe 333. Preferably, at least one of the surfaces through which light emanates, i.e., at least one of the inner surface 343 of the light pipe 333, the outer surface 334 of the light pipe 334, the inner surface 345 of the cavity 342 of the housing 3331 or the outer surface 344 of the housing 331 is roughened to promote light diffusion. Preferably, the roughened surface is lambertian or near-lambertian. In other words, the roughened surface diffuses all or nearly all of the light passing through it to produce a desirous glowing affect. The roughening can be performed by a sandblasting function or a simpler mechanism, such as using conventional sandpaper, scouring pads, steel wool, etc. One preferred methodology involves using a nylon web/abrasive mineral product sold under the SCOTCHPLY™. Various other means for roughening one or more of the surfaces 343, 334, 345 and 344 will be apparent to those skilled in the art. Further, various ways to construct the base assembly 332 will be apparent to those skilled in the art.

Figure 18:
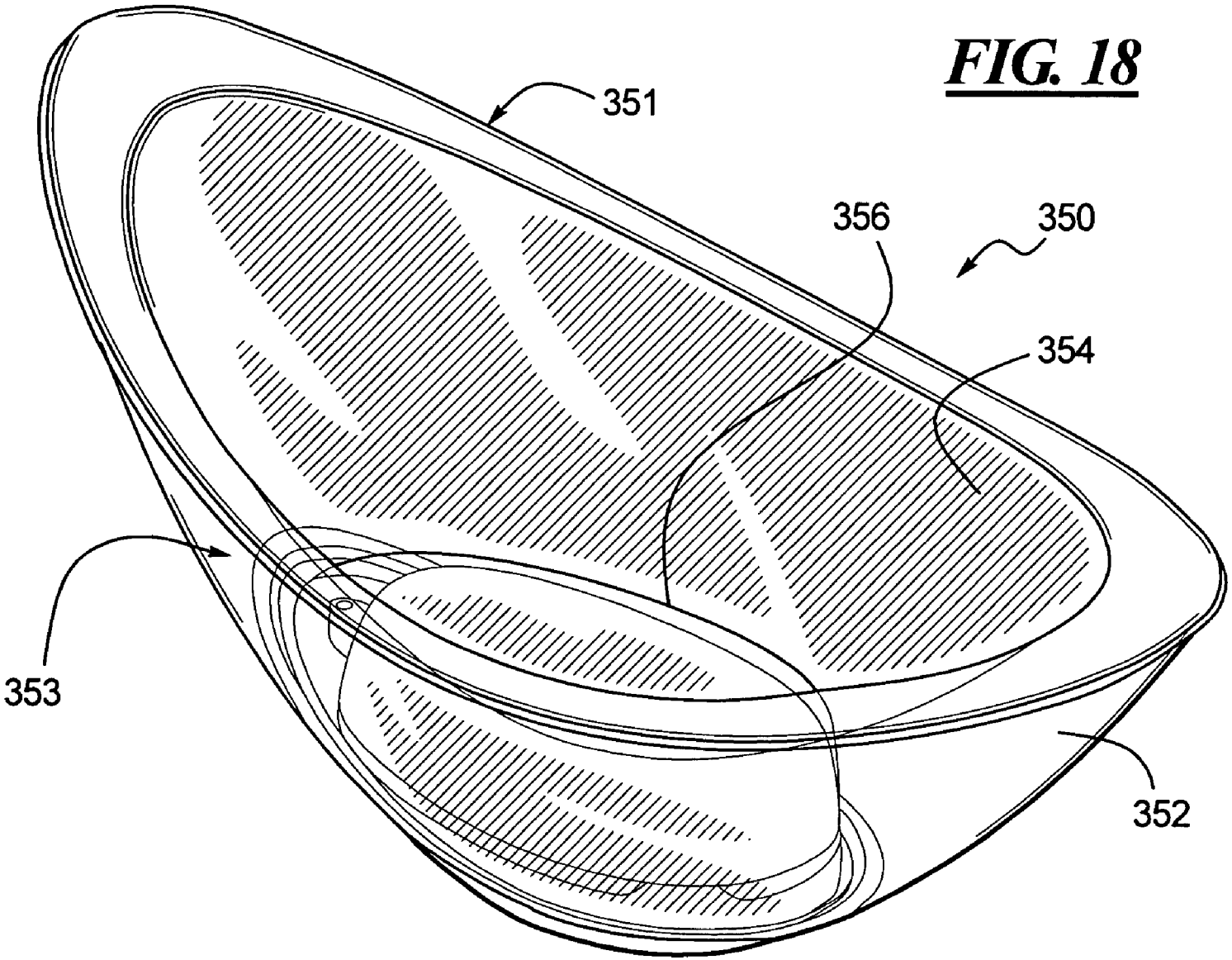
FIG. 18 is a perspective view of a light object according to yet another disclosed embodiment.

Turning to another embodiment, FIG. 18 discloses a bowl light object 350 which includes a bowl structure 351 that includes a continuous sidewall 352 that extends upwardly from a base 353 and that defines a container area shown at 354. The base assembly 353 is shown in an exploded view in FIG. 19. The base plate 355 supports the other elements within the cavity 356 of the bowl structure 351. The PCB 356 accommodates a plurality of LEDs or LED clusters shown generally at 357. Power is provided to the PCB 356 by way of the battery 358 and port 359. A battery holder is shown at 361. The various light show, ON/OFF, pause and flicker functions are provided by way of the interface button plate 362. A supporting button plate is shown at 363 which provide a supporting frame for the buttons 308. A microcontroller chip is shown at 365. The light pipe 366 and roughened outer surface 367 provide generally the same function as the light pipe 333 as shown in FIGS. 15-17. The bowl 350 includes the continuous and generally upwardly extending sidewall 352 which forms a container area as best seen in the sectional view of FIG. 20. The lower portion of the bowl structure 351 includes a cavity 368 which houses the light pipe 366, battery 358, battery holder 361, and the other components within the recess 368 and above the base plate 355. Light from the LED clusters is directed upward and through the light pipe 366 and is diffused through the sidewall 352 of the bowl structure 351 to provide a desired glowing affect.

The interfaces and possible functionalities for the light objects 330 and 350 are further illustrated in FIGS. 21-24 respectively. Turning first to FIGS. 21 and 22, the PCB 335 and interface housing 338 are shown. The PCB 335 preferably includes space for a memory card, a sound card, a temperature sensor, an alarm clock function, a transceiver and a motion activated switch as shown in FIG. 21. The board 335 also preferably includes a connection to a USB port 311 for connection to a personal computer or control station 313 which is preferably connected to the Internet shown at 312. The memory card 371, sound card 372, temperature sensor 373, alarm clock circuitry 374, and motion activated switch 375 can all be disposed on the board 335 or in other locations within the light object 350. The specifics for the circuitry of such functions will be apparent to those skilled in the art and may vary widely.

Another option would be to include an reservoir 381 containing an active such as fragrance, insecticide, perfume, medicament, essential oil, etc. that can be dispensed by a dispense element 380 linked to the board 338 so that the active can be released from the reservoir 381 during a light show or periodically.

In FIG. 22, seven buttons are shown which may include four buttons for four different light shows shown at 305, an ON/OFF button 308, a pause button 306 and a flicker button 307. One of the light show buttons 305 may be used for a different function, such as an alarm function or synch function. The button arrangements are not important and various button configurations for the interfaces will be apparent to those skilled in the art.

Similar functions are illustrated in FIGS. 23 and 24 for the PCB board 356 of the light bowl object 350.

Turning to FIG. 24, the same button configuration as shown in FIG. 13 is illustrated. Again, the button configuration and general interface configurations can vary widely as will be apparent to those skilled in the art.

It is also anticipated that various other sensors and/or switches could be used to control the disclosed light objects. For example, a light sensor could be provided to turn the device on or off based on ambient light in the room, a sound sensor could be provided to turn the device on in response to detected sounds, a motion sensor could be provided to turn the device on in response to detected motion near the light object, etc. Incorporation of these types of conventional sensors is within the knowledge of one of ordinary skill in the art. Therefore, a detailed description of each of these features has been omitted for the sake of brevity.

The embodiments discussed above are representative of preferred embodiments and are provided for illustrative purposes only. Although specific structures, dimensions, components, etc., have been shown and described, such are not limiting. The various features and elements of the embodiments can be interchanged, rearranged, omitted, and/or combined in various different combinations to achieve a desired result.

For example, while the first light source is shown and described as being located adjacent to the opening in the first embodiment (FIG. 2), and located in the central part of the housing cavity in the second embodiment (FIG. 6), the location and configuration of the light sources can easily be interchanged or modified, particularly with the use of light pipes as illustrated in FIGS. 16 and 18. That is, as shown in FIGS. 13-24, a substantially planar light interface can be used and the need to place a light source at a housing interface as shown in FIG. 2 becomes unnecessary. Conversely, the first light source of the first embodiment could be relocated to a central part of the cavity.

While the bases of the preferred embodiments are illustrated as being specific to the shape of the housing, it is contemplated that a single standard-sized base could be designed to be used with multiple different housings. Thus, a user could buy one base and multiple housings for different occasions or seasons. Alternatively, the base could be designed so as to be used without a housing, or could be designed for use with one or more other shades, panels, decorations, and the like.

Also, the user interface of the first embodiment could easily be used to control the second embodiment and vice versa.

Additionally, while the housings of the preferred embodiments are described as being substantially clear and un-concluded, it may be desirable in some applications to, for example, make the housing of a light object color tinted, to include particles (e.g., reflective particles or material having different refractive index than housing material) or air bubbles suspended in the housing, or the like. The only requirement is that the housing be translucent, as that term is used herein.

While the light sources are shown and described as one or more LEDs or RGB LED arrays, other lighting elements may alternatively be used as the first and second light sources, such as incandescent bulbs, fluorescent bulbs, or the like. Moreover, any number, shape, and size of lighting elements may advantageously be used as the first and second light sources, based on various design considerations such as power consumption, desired light intensity, operating temperature, and the like.

While the switches of the user interfaces of the first two embodiments are shown as two- or three-position switches or push-button switches, other types of switches could also be used. In one alternative, one or more of the switches could be activated by touching anywhere on the device, by applying a conductive coating (e.g., Indium Titanium Oxide) to the surface of the housing and/or the base. When the user touches a part of the light object coated with the conductive coating, this would amount to moving the control switch to the next position, cycling the mode switch to the next mode, freezing the mode, or moving the flicker switch to the next position in the described preferred embodiments. Alternatively, if the base is made of a conductive metal, the touch control could be applied to the base without the need for any conductive coating. In another alternative, one or more of the switches could be rotary switches.

The user interface may also include a dial that indicates the color that the LEDs should be set to for a solid color of any hue. This dial may be labeled with a rainbow that allows the user to select the color that pleases them at any time.

In yet another alternative, one or more of the switches could be activated by remote control, by providing a remote control unit with a user interface thereon and providing a sensor on the base of the light object for receiving signals from the remote control unit. Such a remote control arrangement can be carried out using infrared or other suitable electromagnetic radiation, etc. The implementation of such a system is within the skill of one of ordinary skill in the art and will, therefore, not be described further herein.

In yet another alternative, one or more of the switches can be mechanically actuated when the entire object is pressed down by a user, or when the housing is pressed down relative to the base.

In another alternative, a portion of the program memory containing the light show data onboard the microcontroller and/or memory may be reprogrammed with new light show data via a standard personal computer through a serial, USB, or other known interface.

These and other modifications and variations are contemplated within the scope of this disclosure.

INDUSTRIAL APPLICABILITY

Disclosed light objects provide various color changing light shows and/or illumination modes, and a user interfaces for the same are also disclosed. The disclosed light objects provide entertainment and decoration and are aesthetically pleasing. Moreover, the user interfaces make the light objects easy to use and control.

What is claimed:

1. A decorative light object comprising:

a translucent housing having a bottom opening, the housing comprising an open top, a sidewall defining a container portion, and a cavity comprising an inner surface;

a base assembly removably covering the bottom opening, the base assembly comprising a rigid bottom surface and light show circuitry, the light show circuitry comprising a user interface, a memory for storing a plurality of light shows and at least one light group, the user interface comprising at least one switch for selectively recalling one of the plurality of light shows from the memory, the rigid bottom surface and the user interface being configured so as to prevent contact between the at least one switch and a surface upon which the decorative light object is placed;

a light pipe disposed over the light group, the light pipe comprising an outer surface, and the light pipe shaped so that the outer surface of the light pipe is evenly spaced apart from the inner surface of the cavity of the housing; and a reservoir of the housing containing an active selected from the group consisting of fragrance, insecticide, medicament, perfume, the light object also comprising a dispense element to dispense the active from the reservoir during the light show or periodically, the dispense element linked to the light show circuitry, wherein the base assembly is separated from the container portion by a bottom wall.

2. The object of claim 1 wherein the light group comprises a cluster of light emitting diodes (LEDs).

3. The object of claim 2 wherein the cluster comprises red, green, blue (RGB) LEDs.

4. The object of claim 1 further comprising a translucent light pipe disposed over the light group.

5. The object of claim 1 wherein the light pipe comprises an inner surface and an outer surface, at least one of the inner and outer surfaces having a rough texture that diffuses light passing through the light pipe.

6. The object of claim 1 wherein the housing has an inner surface that defines the cavity, the inner surface having a rough texture that diffuses light passing through the housing.

7. The object of claim 1 wherein the housing has an outer surface, the outer surface having a rough texture that diffuses light passing through the housing.

8. The object of claim 1 wherein the interface comprises a pause function and a pause switch to stop a light show in progress.

9. The object of claim 1 wherein the light show circuitry comprises a flicker function and the user interface comprises flicker switch to activate the flicker function.

10. The object of claim 1 wherein the light show circuitry comprises a printed circuit board (PCB) with a connection port and the memory comprises a memory card removably connected to the port of the PCB, and wherein the memory card is interchangeable with another memory card with at least one different light show stored thereon.

11. The object of claim 1 wherein the light show circuitry comprises a printed circuit board (PCB) with a universal serial bus (USB) connection port, and wherein at least one different light show can be downloaded to the memory through the USB port.

12. The object of claim 1 wherein the light show circuitry comprises at least one microprocessor programmed with a programmable alarm function.

13. The object of claim 1 wherein the light show circuitry comprises a microprocessor and a temperature sensor linked to the microprocessor, the microprocessor programmed with a temperature function and wherein the microprocessor alters the at least one light show stored in the memory in response to ambient temperature as detected by the temperature sensor.

14. The object of claim 1 wherein the object further comprises a transceiver and the light show circuitry comprises a microprocessor linked to the transceiver, the user interface also comprising a transceiver, the user interface being removable from the base assembly and capable of sending signals remotely to the microprocessor through the transceivers.

15. The object of claim 1 wherein the object further comprises a transceiver and the light show circuitry comprises a microprocessor linked to the transceiver, the transceiver sending signals to and receiving signals from at least one other light object also equipped with a transceiver.

16. The object of claim 1 wherein the light show circuitry comprises a sound card and a microprocessor linked to the sound card.

* * * * *